US008220955B2

(12) United States Patent
Kwak et al.

(10) Patent No.: US 8,220,955 B2
(45) **Date of Patent: *Jul. 17, 2012**

(54) LIGHTING DEVICE

(75) Inventors: Young Kuk Kwak, Seoul (KR); Sang Jun Hong, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/190,180

(22) Filed: Jul. 25, 2011

(65) Prior Publication Data

US 2011/0280000 A1 Nov. 17, 2011

(51) Int. Cl.
*F21V 7/00* (2006.01)

(52) U.S. Cl. ..... 362/217.13; 362/249.02; 362/225; 362/219; 362/217.05

(58) Field of Classification Search ..... 362/217.13, 362/217.1, 225, 217.01, 217.05, 217.17, 362/249.02, 800

See application file for complete search history.

(56) References Cited

U.S. PATENT DOCUMENTS

| | | | | |
|---|---|---|---|---|
| 5,929,788 | A * | 7/1999 | Vukosic | 340/908.1 |
| 7,270,448 | B1 * | 9/2007 | Maley, Sr. | 362/334 |
| 8,061,867 | B2 * | 11/2011 | Kim et al. | 362/217.17 |
| 2003/0016536 | A1 * | 1/2003 | Lin | 362/250 |
| 2006/0164836 | A1 * | 7/2006 | Suehiro et al. | 362/294 |

FOREIGN PATENT DOCUMENTS

| | | |
|---|---|---|
| DE | 20 2009 015 012 | 2/2010 |
| EP | 0574761 | 12/1993 |
| EP | 0 368 847 | 9/1994 |
| EP | 1519103 | 3/2005 |
| JP | 2001-118408 | 4/2001 |
| JP | 2002-219994 | 8/2002 |
| JP | 2003-249685 | 9/2003 |
| JP | 2004-165114 | 6/2004 |
| JP | 2008-218129 | 9/2008 |
| JP | 2009-016092 | 1/2009 |
| JP | 2009-123503 | 6/2009 |
| KR | 10-2005-0000957 | 1/2005 |
| KR | 10-2005-0121650 | 12/2005 |
| KR | 10-2006-0036039 | 4/2006 |
| KR | 10-2009-0010016 | 1/2009 |
| KR | 10-2010-0091421 | 8/2010 |

OTHER PUBLICATIONS

European Search Report for Application 11174204.5-2423 dated Sep. 16, 2011.

Korean Office Action for Application 10-2010-0090905 dated Dec. 17, 2010.

Korean Office Action for Application 10-2010-0090906 dated Jan. 8, 2011.

Korean Office Action for Application 10-2010-0090910 dated Jan. 8, 2011.

* cited by examiner

*Primary Examiner* — Laura Tso
(74) *Attorney, Agent, or Firm* — KED & Associates, LLP

(57) ABSTRACT

A lighting device may be provided that includes a housing, a coupling member coupled to the housing, a reflector coupled between the housing and the coupling member, and a light source unit coupled to the coupling member to emit light toward the reflector. A first portion of a first body of the light source unit may be coupled to the coupling member, and a second portion of the first body may include a light source module that includes a light to emit light toward the reflector.

20 Claims, 16 Drawing Sheets

Fig. 3
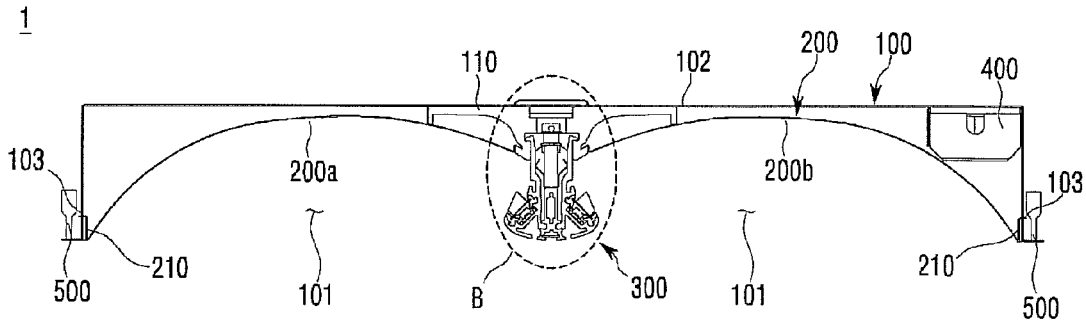
Fig, 4
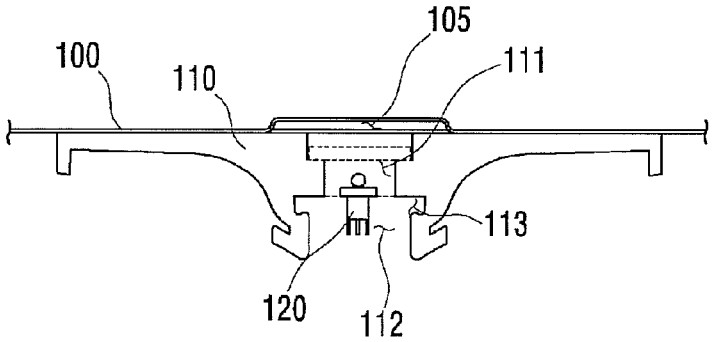

LIGHTING DEVICE

CROSS-REFERENCE TO RELATED APPLICATION

This application claims priority under 35 U.S.C. §119 from Korean Application Nos. 10-2010-0090905, 10-2010-0090906 and 10-2010-0090910, filed Sep. 16, 2010, the subject matters of which are incorporated herein by reference.

BACKGROUND

1. Field

Embodiments may relate to a lighting device.

2. Background

A light emitting diode (LED) is a semiconductor element for converting electric energy into light. The LED may have advantages of low power consumption, a semi-permanent span of life, a rapid response speed, safety and an environment-friendliness. Therefore, previous light sources may be replaced with the LED. The LED is being increasingly used as a light source for lighting devices such as lamps used interiorly and exteriorly, a liquid crystal display device, an electric sign and a street lamp and/or the like.

SUMMARY

One embodiment is a lighting device. The lighting device includes: a housing; a coupling member coupled to the housing; a reflector coupled between the housing and the coupling member; and a light source unit coupled to the coupling member to emit light toward the reflector, wherein the light source unit includes a first body and a second body, wherein at least one first portion of the first body is coupled to the coupling member, and wherein at least one second portion of the first body includes a light source module having a light emitting diode to emit light toward the reflector.

Further another embodiment is a lighting device. The lighting device includes: a housing; a coupling member coupled to the housing; a reflector coupled between the housing and the coupling member; a light source unit to couple to the coupling member, the light source unit including a light emitting diode (LED) to emit light toward the reflector; a first end cap coupled to a first end of the light source unit; and a second end cap coupled to a second end of the light source unit.

BRIEF DESCRIPTION OF THE DRAWINGS

Arrangements and embodiments may be described in detail with reference to the following drawings in which like reference numerals refer to like elements and wherein:

FIG. 3 is a cross sectional view of the lighting device according to the embodiment;

FIG. 4 is a cross sectional view of a coupling member;

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1A:
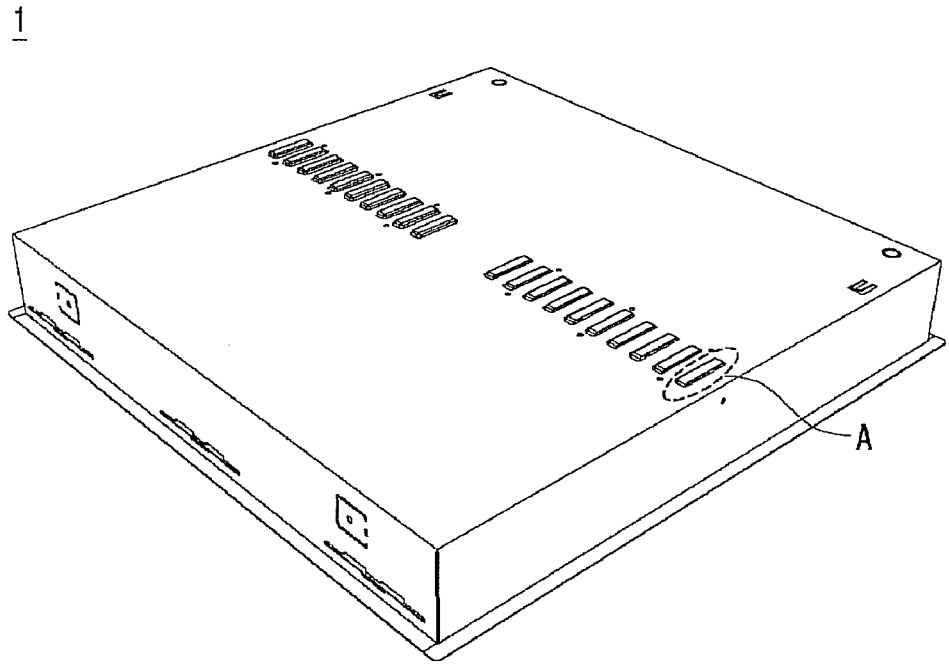
FIG. 1*a* is a top view of a lighting device according to an embodiment.
Figure 1B:
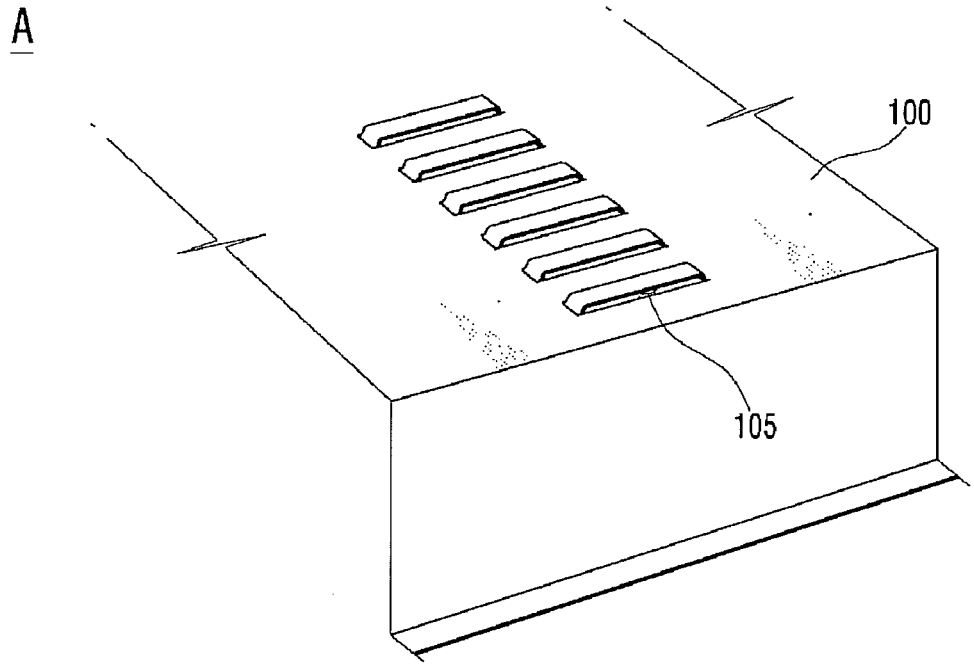
FIG. 1*b* is a view showing an enlarged area 'A' of FIG. 1*a;*
Figure 2A:
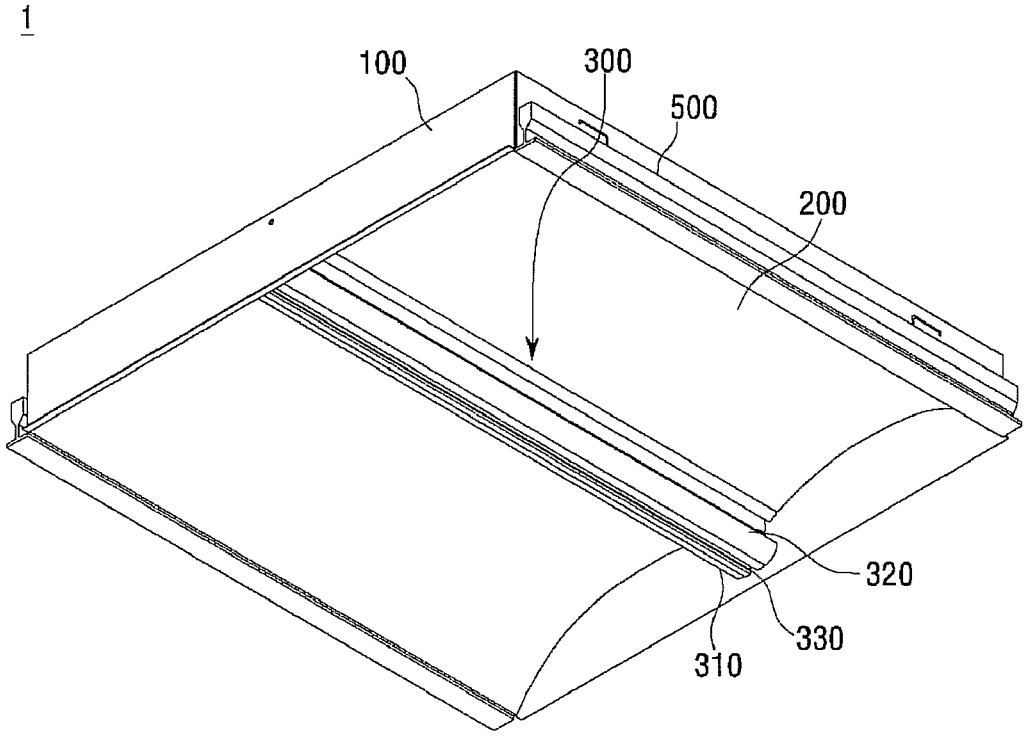
FIG. 2*a* is a bottom top view of the lighting device according to the embodiment.
Figure 2B:
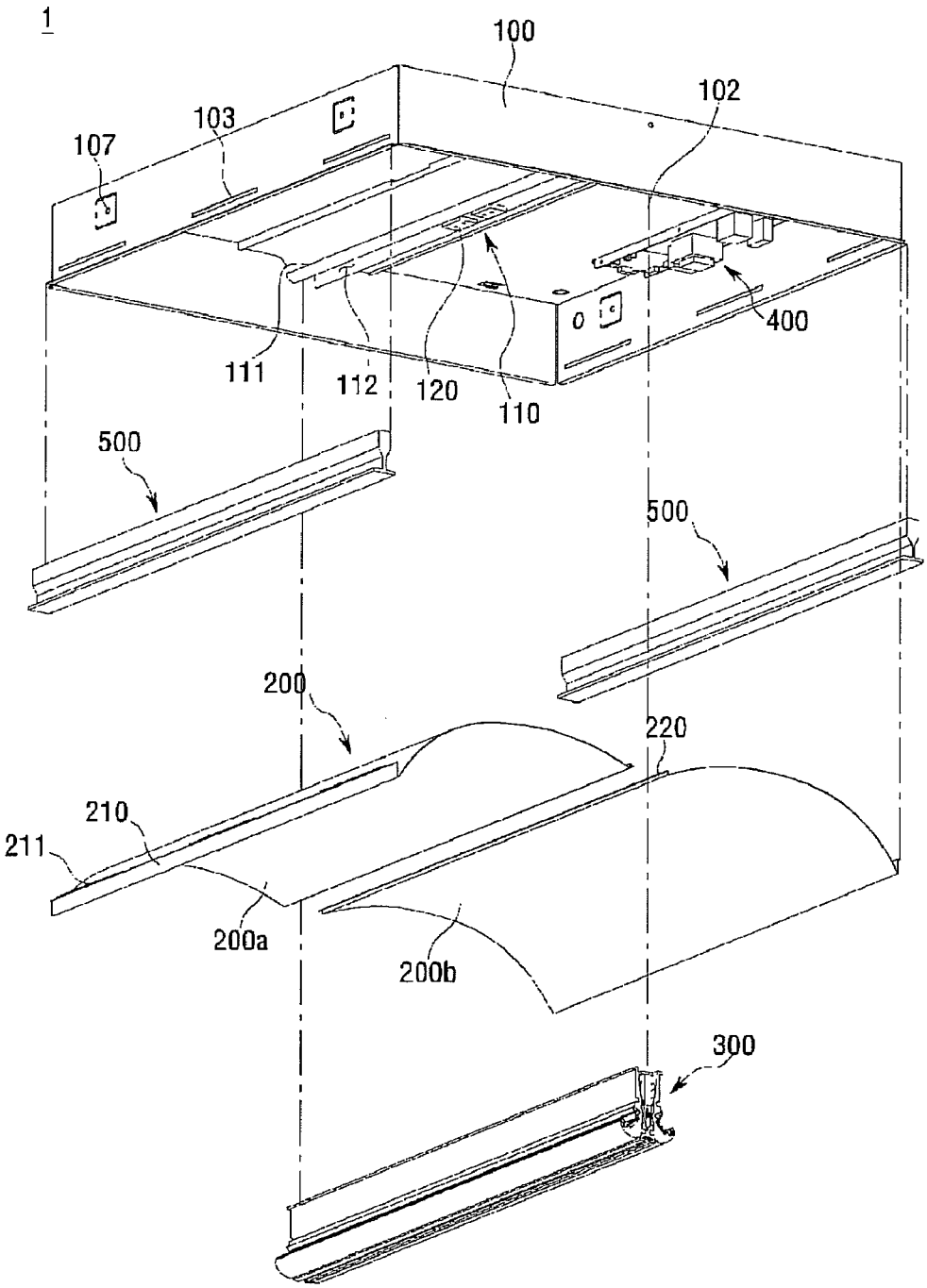
FIG. 2*b* is an exploded view of the lighting device according to the embodiment.
Figure 5:
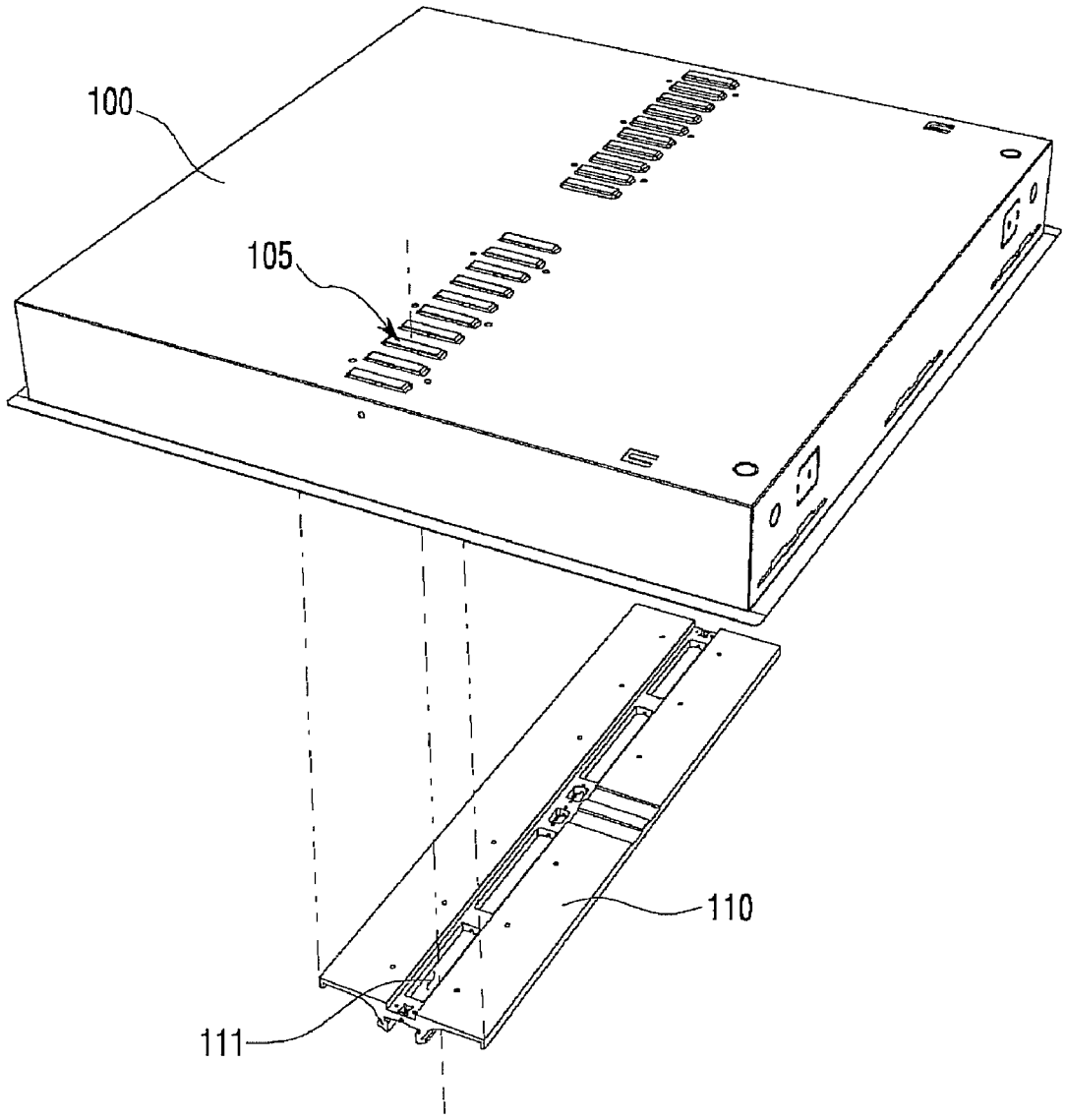
FIG. 5 shows a housing separated from a coupling member.

FIG. 1*a* is a top view of a lighting device according to an embodiment. FIG. 1*b* is a view showing an enlarged area 'A' of FIG. 1. FIG. 2 is a bottom top view of the lighting device according to the embodiment. FIG. 2*b* is an exploded view of the lighting device according to the embodiment. FIG. 3 is a cross sectional view of the lighting device according to the embodiment. FIG. 4 is a cross sectional view of a coupling member according to the embodiment. FIG. 5 shows a housing separated from a coupling member. Other embodiments and configurations may also be provided.

As shown in FIG. 1 to 5, the lighting device 1 may include a housing 100, a coupling member 110, a reflector 200, a light source unit 300 and a power supply unit 400.

1. The Housing 100 and the Coupling Member 110

The housing 100 may have a shape of a box for accepting the housing 100, the coupling member 110, the reflector 200 and the power supply unit 400. While the shape of the housing 100 as viewed from the outside is quadrangular, the housing 100 may have various other shapes without being limited to this description.

The housing 100 may be made of a material capable of efficiently releasing heat. For example, the housing 100 may be made of a metallic material such as Al, Sn, Ni, Ag, Cu, Ti, Mo, W, Au and Pt, and so on.

A connecting recess 107 (or connection groove) for electrically connecting the power supply unit 400 to an external power supply may be formed on at least one of a lateral surface or a top surface of the housing 100.

The housing 100 may include a down opening 101 such that light radiated from the light source unit 300 may be reflected by the reflector 200 and may be emitted to the outside of the housing 100. A first opening, a second opening and a third opening are means for forming an indoor air circulation path, and may also be regarded as an air passage for allowing air to pass therethrough.

The light source unit 300 may include a light emitting device such as a light emitting diode (LED).

As shown in FIGS. 1*a* and 1*b*, at least one first opening 105 is formed on a top surface of the housing 101. The first opening 105 may penetrate the top surface of the housing 100. For example, the first opening 105 may have a bent hole shape that projects from the top surface of the housing 100 and has at least one open side. The shape of the first opening 105 is not limited to this description, and any shape that penetrates the top surface of the housing 100 may be the shape of the first opening 105.

The lighting device 1 may be provided on an external support member such as a ceiling or a wall surface. The lighting device 1 may be provided in an insertion unit of the external support member. The insertion unit may correspond to a shape of the lighting device 1. A coupling frame 500 may be coupled to a lower portion of a lateral surface of the housing 100, so that the lighting device 1 may be securely coupled to the external support member.

The coupling member 110 may be coupled on an inner upper surface 102 of the housing 100. The coupling member 110 may be coupled to the housing 100 by any one of various methods. For example, the coupling member 110 may be coupled to the housing 100 by a coupling screw, an adhesive agent or other type.

The coupling member 110 may be formed to extend from the upper surface 102 of the housing 100 in a first direction. For example, the coupling member 110 may extend from one inner wall surfaces of the housing 100 to an opposite inner wall surface.

The housing 100 and the coupling member 110 may be attachable to and removable from the reflector 200. A first recess 103 (or first groove) may be formed on the inner wall surface of the housing 100. A first side 210 of the reflector 200 is inserted into the first recess 103. One first recess 103 may be formed or a plurality of the first recesses 103 may be formed. A second recess 111 (or second groove) may be formed on an outer wall surface of the coupling member 110. The second recess 111 may extend in the first direction. A second side 220 of the reflector 200 may be inserted into the second recess 111. As such, the housing 100 and the coupling member 110 may attach and support the reflector 200 by inserting the first side 210 of the reflector 200 into the first recess 103 (of the housing 100) and by inserting the second side 220 of the reflector 200 into the second recess 111 (of the coupling member 110).

As shown in FIG. 4, a first insertion recess 112 (or first insertion groove) is formed in a middle part of the coupling member 110 in a direction of the inner upper surface 102 of the housing 100. A part of the light source unit 300 may be inserted into the first insertion recess 112. The first insertion recess 112 may extend in the first direction.

As shown in FIG. 5, the coupling member 110 may include at least one second opening 111. The second opening 111 may open upper and lower sides of the coupling member 110. The second opening 111 may be formed at a location corresponding to the first opening 105 formed in the housing 111. A plurality of the second openings 111 may be formed in the first direction.

A plurality of locking recesses 113 (or locking grooves) may be formed in the inner wall surface of the first insertion recess 112. A first projection 310*c* and a second projection 320*c* of the light source unit 300, shown in FIG. 6, may be inserted into the locking recess 113. The first projection 310*c* and the second projection 320*c* may be inserted into and caught by the locking recess 113, so that the light source unit 300 is strongly coupled and attached to the coupling member 110. The coupling of the light source unit 300 and the coupling member 110 may be described below in more detail.

As shown in FIG. 2*b*, a first connection terminal 120 may be provided in the first insertion recess 112. When the light source unit 300 is inserted into the first insertion recess 112, the first connection terminal 120 may be electrically connected to a second connection terminal 336 of the light source unit 300. When the first connection terminal 120 is connected to the second connection terminal 336, electric power and/or a driving signal may be transferred to the light source unit 300 through the first connection terminal 120 and the second connection terminal 336.

Based on design of the light source device, one first connection terminal 120 or a plurality of the first connection terminals 120 may be provided. Detailed descriptions of the first connection terminal 120 and the second connection terminal 336 may be provided below.

The coupling member 110 may perform a function of directly releasing heat generated from the light source unit 300 and/or transferring the heat to the housing 100. The coupling member 110 may be formed of a material capable of efficiently releasing and/or transferring the heat. For example, the coupling member 110 may be made of a metallic material such as Al, Sn, Ni, Ag, Cu, Ti, Mo, W, Au and/or Pt.

Part of the coupling member 110 may have an uneven structure. The uneven structure may widen a surface area of the coupling member 110 and may improve a heat release effect.

2. The Reflector 200

The reflector 200 may include a first reflector 200*a* and a second reflector 200*b*. Each of the first reflector 200*a* and the second reflector 200*b* may be attachable to and/or removable from the housing 100 and the coupling member 110. The first reflector 200*a* may include the first side 210 to couple to the housing 100 and the second side 220 to couple to the coupling member 110. The second reflector 200*b* may also include the first side 210 and the second side 220.

For example, as shown in FIG. 2*b*, when the first reflector 200*a* is coupled to the housing 100 and the coupling member 110, the first side 210 (of the first reflector 200*a*) may be inserted into the first groove 103 (of the housing 100), and the second side 220 of the first reflector 200*a* may be inserted into the second opening 111 (of the coupling member 110).

The first side 210 (of the reflector 200) may have a level difference. The second side 220 (of the reflector 200) may also have a level difference.

At least one insertion end 211 may be formed at the first side 210 (of the reflector 200). The insertion end 211 may be inserted into the first recess 103 of the housing 100. A shape of the first recess 103 of the housing 100 may correspond to the shape of the insertion end 211.

The first reflector 200*a* and/or the second reflector 200*b* may have a parabola-shaped surface and may extend in the first direction. Therefore, the first reflector 200*a* and the second reflector 200*b* may have a parabolic shape having two parabolic surfaces. The shape of the first reflector 200*a* and the second reflector 200*b* may change based on a desired lighting or a user's choice.

The reflector 200 may be made of a metallic material or a resin material that has a high reflection efficiency. For example, the resin material may include any one of PET, PC or PVC resin. The metallic material may include any one of Ag, alloy including Ag, Al, or an alloy including Al.

The surface of the reflector 200 may be coated with Ag, Al, white photo solder resist (PSR) ink, a diffusion sheet and/or the like. Otherwise, an oxide film may be formed on the surface of the reflector 200 by an anodizing process.

The material and the color of the reflector 200 may not be limited to the above description, and may be variously selected depending on a lighting generated by the lighting device.

3. The Power Supply Unit 400

When the power supply unit 400 is connected to the light source unit 300, the power supply unit 400 may supply electric power and/or a driving signal.

As shown in FIGS. 2*b* and 3, the power supply unit 400 may be provided in a space determined by the inner upper surface 102 and the inner wall surface of the housing 100 and the reflector 200. Due to a parabola shape of the reflector 200, an empty space may be formed between the reflector 200 and a corner inside the housing 100. As a result, the power supply unit 400 may be provided in the empty space. More specifically, the power supply unit 400 may be provided on the inner upper surface 102 of the housing 100.

The power supply unit 400 may convert an alternating current (AC) electric power into a direct current (DC) electric power, and may output the direct current (DC) electric power.

The power supply unit 400 may be electrically connected to the light source unit 300 through a wire or a flexible printed circuit board (FPCB). For example, a wire or a FPCB may extend from the power supply unit 400 and may be electrically connected to the first connection terminal 120 through the connecting recess 107 formed in the coupling member 110. The first connection terminal 120 may be electrically connected to the second connection terminal 336. As a result, the power supply unit 400 may be electrically connected to the light source unit 300.

4. The Light Source Unit 300

Figure 6A:
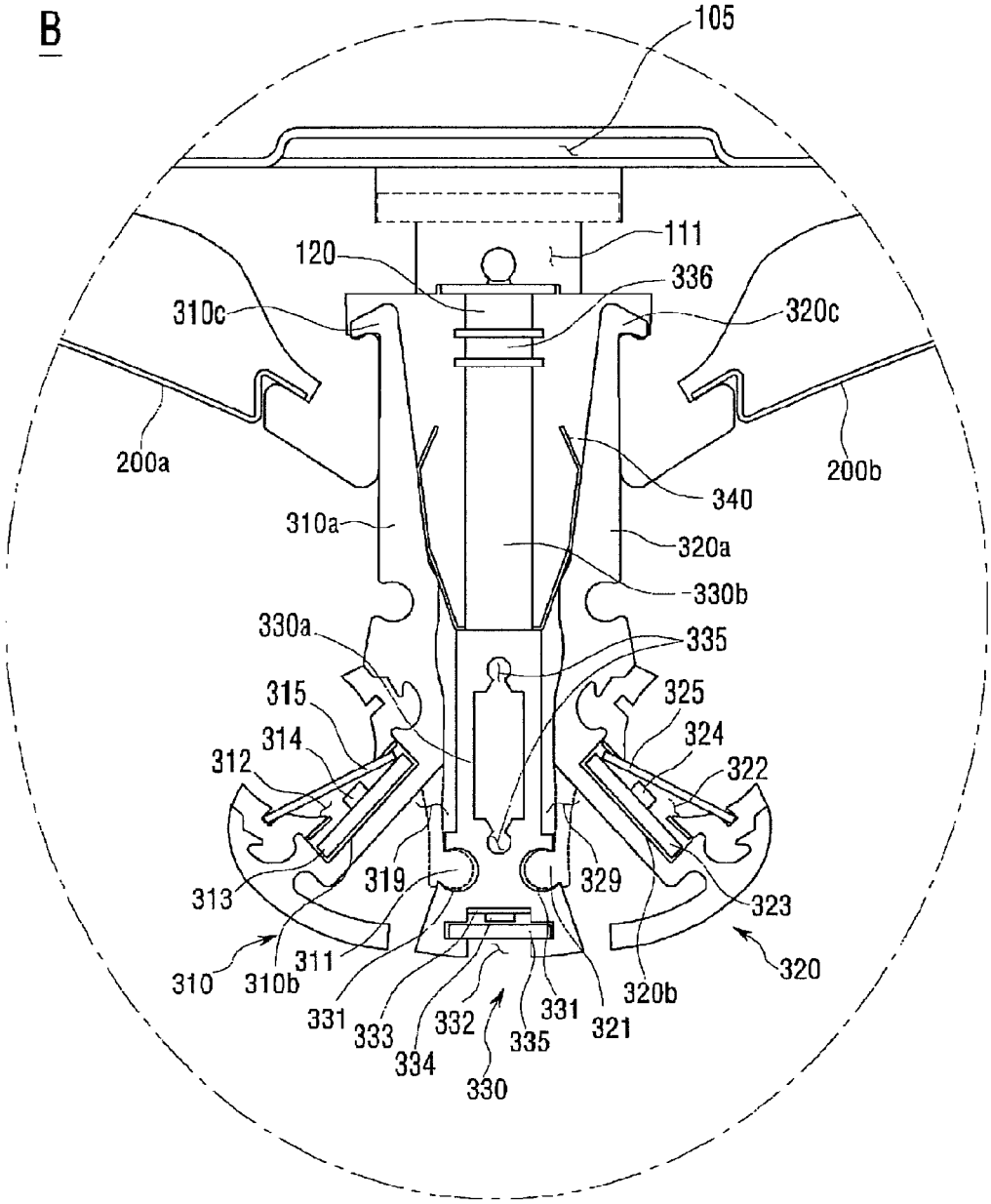
FIG. 6*a* is a view showing an enlarged area 'B' of FIG. 3.
Figure 6B:
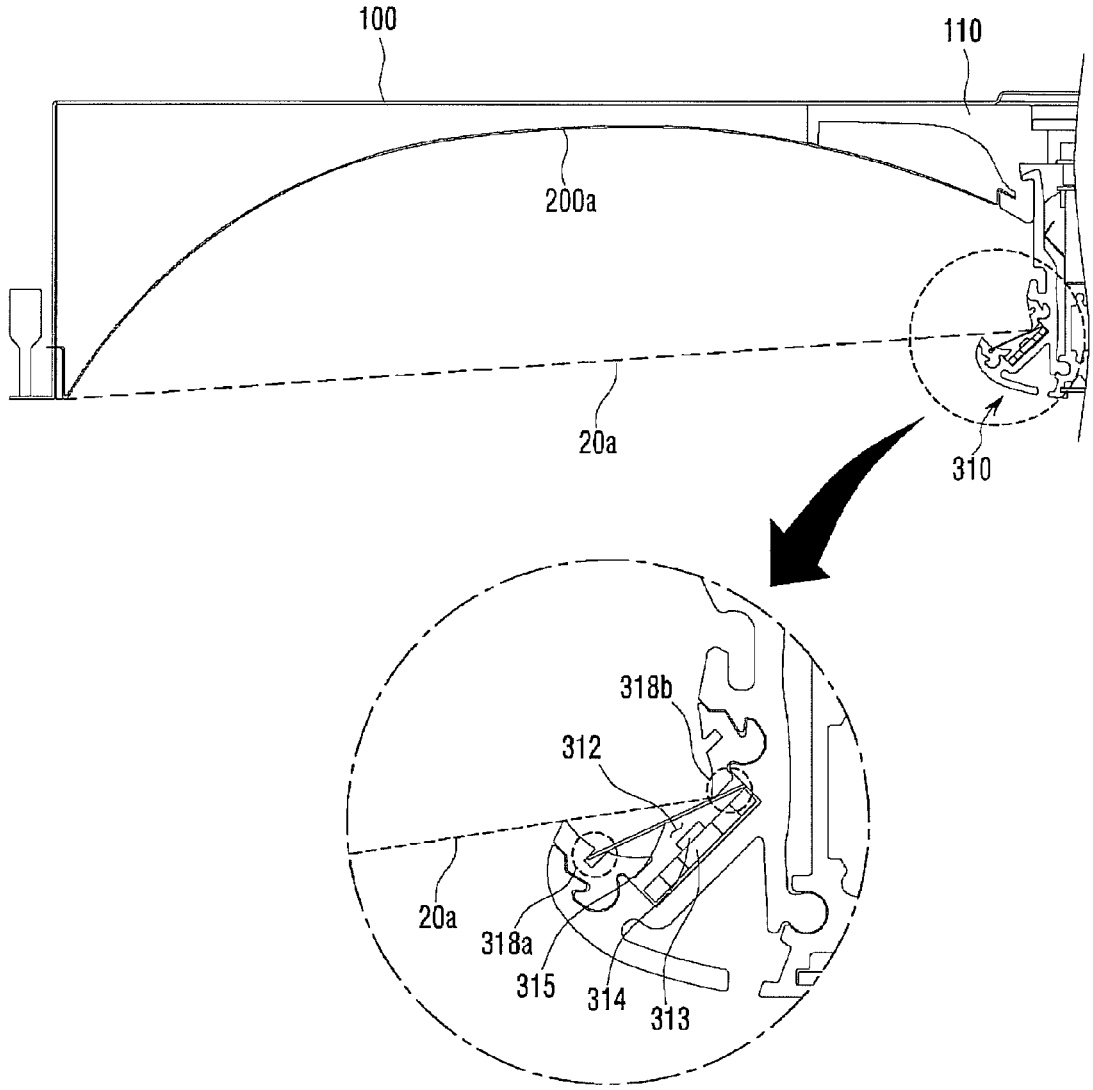
FIG. 6*b* is a view showing how an optical structure is installed.
Figure 7:
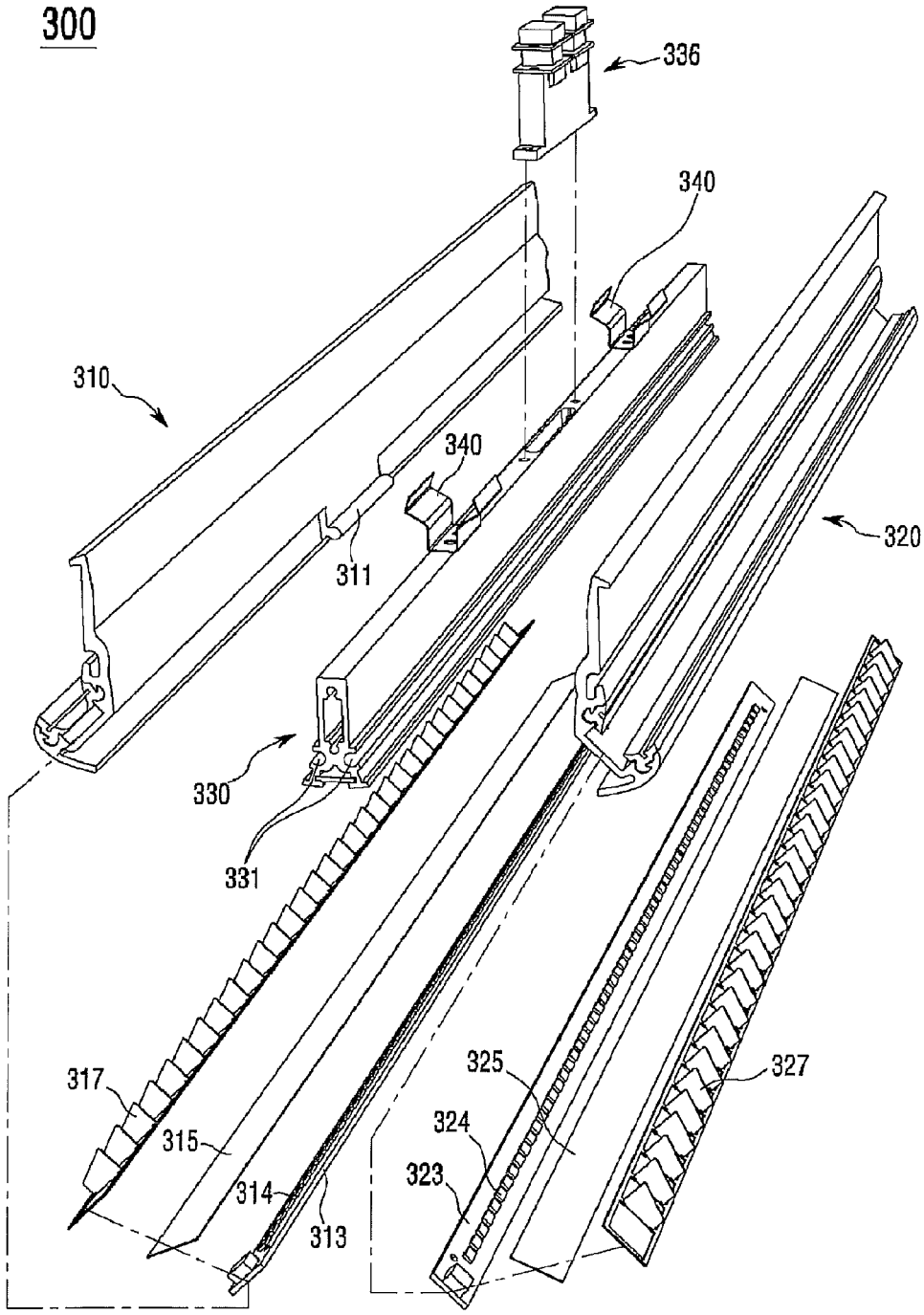
FIG. 7 is an exploded view of a light source unit.

FIG. 6*a* is a view showing an enlarged area 'B' of FIG. 3. FIG. 6*b* is a view showing how an optical structure is installed. FIG. 7 is an exploded view of a light source unit. Other embodiments and configurations may also be provided.

Referring to FIGS. 6*a*, 6*b* and 7, the light source unit 300 may include a first body 310, a second body 320, a middle body 330, a first main light source module 313, 314 and 315, a second main light source module 323, 324 and 325, an auxiliary light source module 333, 334 and 335, and a spring 340. The first body 310, the second body 320 and the middle body 330 may form a body of the light source unit 300. The first body 310, the second body 320 and the middle body 330 may extend in the first direction (i.e., in a direction of the length of the reflector 200).

The configuration of the light source unit 300 may be described in more detail.

A) The First Body 310

A first portion (or one side) of the first body 310 may be connected to the coupling member 110. A second portion (or other side) of the first body 310 may include a light module to emit light to the reflector 200.

The first body 310 may include a third coupling unit 310*a*. The third coupling unit 310*a* may form an upper portion of the first body 310. A part of the third coupling unit 310*a* may be inserted into the first insertion recess 112 of the coupling member 110.

The upper end of the third coupling unit 310*a* may include the first projection 310*c* formed thereat. The first projection 310*c* may have a shape in which a portion of the upper end of the third coupling unit 310*a* projects outward.

A first light emitting recess 312 may be formed at the lower portion of the first body 310. A basal surface (or bottom surface) of the first light emitting recess 312 may include a first inclined surface 310*b*. The first inclined surface 310*b* may face a reflective surface of the first reflector 200*a*. The first body 310 may include many inclined surfaces as well as the first inclined surface 310*b*. The first inclined surface 310*b* may be inclined with respect to a top surface of the housing 100.

As shown in FIG. 6*a*, an outer surface (or end) of the lower portion of the first body 310 may have a predetermined curved surface. However, embodiments are not limited in their shape of the outer surface of the lower portion. For example, the outer surface of the lower portion of the first body 310 may be angular.

The first light emitting recess 312 may include at least two lateral sides and a basal surface (or bottom surface) on which the first main light source module 313, 314 and 315 is provided. A distance between the two lateral sides of the first light emitting recess 312 may be equal to or less than a width of the basal surface of the first light emitting recess 312. When the distance between the two lateral sides of the first light emitting recess 312 is less than the width of the basal surface of the first light emitting recess 312, the first main light source module 313, 314 and 315 may be provided on the basal surface of the first light emitting recess 312 in a direction perpendicular to a depth direction of the first light emitting recess 312. That is, the first main light source module 313, 314 and 315 may be provided in the first light emitting recess 312 in a sliding way.

The first main light source module 313, 314 and 315 may be provided in the first light emitting recess 312. The first main light source module 313, 314 and 315 may include a first substrate 313, a plurality of main light emitting diodes 314 and a first optical structure 315.

The first substrate 313 may be provided on (or at) the basal surface of the first light emitting recess 312 along the first inclined surface 310*b*.

The plurality of main light emitting diodes 314 may be provided on the first substrate 313 along the first inclined surface 310*b*, and the main light emitting diodes 314 may be electrically connected to the first substrate 313. Otherwise, a plurality of electrodes may be provided on the first inclined surface 310*b*, and then the plurality of main light emitting diodes 314 may be electrically connected to the first substrate 313, respectively. The plurality of main light emitting diodes 314 may be arranged in the first light emitting recess 312 in the form of an array.

The plurality of main light emitting diodes 314 may be determined through various combinations of red, green, blue and white light emitting diodes that radiate red, green, blue and white light, respectively.

The plurality of main light emitting diodes 314 may be controlled by electric power and/or a driving signal that are provided by the power supply unit 400, causing the plurality of main light emitting diodes 314 to selectively emit light or to adjust luminance of light.

The first optical structure 315 may be provided on (or at) the plurality of the main light emitting diodes 314. The first optical structure 315 may adjust light distribution and color sense of light radiated from the plurality of main light emitting diodes 314, and the first optical structure 315 may create emotional lighting having various luminance and color senses.

The first optical structure 315 may be inserted in a sliding way into side recesses (or grooves) 318*a* and 318*b* formed in the inner surface of the first light emitting recess 312. The side recesses 318*a* and 318*b* may extend in the first direction. The first optical structure 315 may be coupled to the first light emitting recess 312 by being inserted into the side recesses 318*a* and 318.

The first optical structure 315 may include at least one of a lens, a diffusion sheet or a phosphor luminescent film (PLF). FIG. 7 also shows fins 317 provided over the diffusion sheet 315. The fins 317 may direct the light from the main light emitting diodes 314.

The lens may include various lenses such as a concave lens, a convex lens and/or a condensing lens according to a design of the lighting device.

The diffusion sheet may evenly diffuse light radiated from the plurality of main light emitting diodes 314.

The phosphor luminescent film (PLF) may include a fluorescent substance. Since the fluorescent substance included in the phosphor luminescent film (PLF) is excited by light radiated from the plurality of main light emitting diodes 314, the lighting device may produce emotional lighting having various color senses by mixing first light radiated from the plurality of main light emitting diodes 314 and second light excited by the fluorescent substance. For example, when the plurality of main light emitting diodes 314 radiate blue light and the phosphor luminescent film (PLF) includes a yellow fluorescent substance excited by blue light, the lighting device may radiate white light by mixing the blue light and the yellow light.

The first optical structure 315 may be coupled to the first light emitting recess 312 through the side recesses 318*a* and 318*b* of the first light emitting recess 312. Accordingly, a lens, a diffusion sheet and/or a phosphor luminescent film (PLF) may be alternately used as the first optical structure 315.

The depth and the width of the first light emitting recess 312 may be variously adjusted according to the light distribution of the plurality of main light emitting diodes 314 provided inside the first light emitting recess 312. In other words, the reflector 200 may provide users with light radiated from the light source unit 300 by adjusting the depth and the width of the first light emitting recess 312, rather than by directly providing users with light radiated from the light source unit 300. As a result, users may be provided with subdued light by reducing glare.

A light distribution angle of light emitted from the first light emitting recess 312 may be from 90° to 110°. The depth and the width of the first light emitting recess 312 may cause light emitted from the first light emitting recess 312 to be incident evenly on the reflector 200, and more particularly to the entire area of the reflector 200.

Additionally, the depth and the width of the first light emitting groove 312 may be adjusted such that a part of light radiated from the plurality of main light emitting diodes 314 may be radiated to the outside through the down opening 101 of the housing 100 and the rest of the light may be reflected by the reflector 200 and may be radiated to the outside through the down opening 101.

As shown in FIG. 6*b*, when the first optical structure 315 is located over a cut-off line 20*a* (i.e., a user's line of sight), the user may feel or see glare. Therefore, the first optical structure 315 may be provided under the cut-off line 20*a* in order to not be visible to the outside. For example, one end of the first optical structure 315 may be provided to be inclined toward an inside of the first light emitting recess 312. That is, a distance may not be uniform between a surface of the first optical structure 315 and the basal surface of the first light emitting recess 312.

The first optical structure 315 may be provided so it is not visible to the outside when the first main light source module 313, 314 and 315 is seated in the first light emitting recess 312 by increasing the depth of the first light emitting recess 312 or where the cut-off line 20*a* of the lighting device 1 is adjusted. Such methods may prevent glare caused by the optical structure, but may reduce the light distribution angle of the main light emitting diode 314 and incur an optical loss. Accordingly, within a range ensuring the light distribution angle of the main light emitting diode 314, an angle at which the first optical structure 315 is provided may be controlled such that the first optical structure 315 is not located over the cut-off line 20*a*. The first optical structure 315 may be provided under the cut-off line 20*a*. The cut-off line 20*a* is an imaginary line that extends from a top one of the side recess 318*b* to a bottom edge of the housing 100.

As shown in FIGS. 6*a* and 7, a first hinge 311 may be formed on the other side of the lower portion of the first body 310. The first hinge 311 may have a shape that protrudes outward. The end of the first hinge 311 may be partially formed along the other side of the lower portion of the first body 310, (i.e., in the first direction). For example, the first hinge 311 may be formed only in a central portion of the other side of the lower portion of the first body 310, or may be formed vice-versa. A plurality of first hinges 311 may also be provided. The end of the first hinge 311 may have a cylindrical shape.

A second insertion recess 331 may be formed on both sides of the lower portion of the middle body 330, respectively. The second insertion recess 331 may have a cylindrical shape that extends in the first direction. The end of the first hinge 311 (of the first body 310) may be inserted into the second insertion recess 331 in a sliding way, so that the first body 310 is coupled to the middle body 330 in such a manner so as to rotate. The first body 310 may rotate at a predetermined angle by using the longitudinal direction of the first hinge 311 as a rotation axis. The structure between the first hinge 311 and the second insertion recess 331 is not limited to this description. Any structure may be accepted as long as the structure can allow the first hinge 311 and the second insertion recess 331 to be coupled to each other such that they may rotate.

In the coupling of the first body 310 and the middle body 330, at least one third opening 319 may be formed in a first coupling unit that connects the first body 310 with the middle body 330. The third opening 319 may correspond to either a space from among a plurality of the first hinges 311 or a space where the first hinge 311 is not formed along the other side of the lower portion of the first body 310.

The outer surface of the other side of the first body 310 may have a predetermined curved surface or may be angular.

B) The Second Body 320

A first portion (or one side) of the second body 320 may be connected to the coupling member 110. A second portion (or other side) of the second body 320 may include a light module to emit light to the reflector 200.

The second body 320 may include a fourth coupling unit 320*a*. The fourth coupling unit 320*a* may form an upper portion of the second body 320. A part of the fourth coupling unit 320*a* may be inserted into the first insertion recess 112 of the coupling member 110.

The upper end of the fourth coupling unit 320*a* may include the second projection 320*c* formed thereat. The second projection 320*c* may have a shape in which a portion of the upper end of the fourth coupling unit 320*a* projects outward.

A second light emitting recess 322 may be formed at the lower portion of the second body 320. A basal surface (or bottom surface) of the second light emitting recess 322 may include a second inclined surface 320*b*. The second inclined surface 320*b* may face a reflective surface of the second reflector 200*b*. The second body 320 may include many inclined surfaces as well as the second inclined surface 320*b*. The second inclined surface 320*b* may be inclined with respect to a top surface of the housing 100.

As shown in FIG. 6*a*, an outer surface (or end) of the lower portion of the second body 320 may have a predetermined curved surface. However, embodiments are not limited in their shape of the outer surface of the lower portion. For example, the outer surface of the lower portion of the second body 320 may be angular.

The second light emitting recess 322 may include at least two lateral sides and a basal surface (or bottom surface) on which the second main light source module 323, 324 and 325 is provided. A distance between the two lateral sides of the second light emitting recess 322 may be equal to or less than a width of the basal surface of the second light emitting recess 322. When the distance between the two lateral sides of the second light emitting recess 322 is less than the width of the basal surface of the second light emitting recess 322, the second main light source module 323, 324 and 325 may be provided on the basal surface of the second light emitting recess 322 in a direction perpendicular to a depth direction of the second light emitting recess 322. That is, the second main light source module 323, 324 and 325 may be provided in the second light emitting recess 322 in a sliding way.

The second main light source module 323, 324 and 325 may be provided in the second light emitting recess 322. The second main light source module 323, 324 and 325 may include a second substrate 323, a plurality of main light emitting diodes 324 and a second optical structure 325.

The second substrate 323 may be provided on (or at) the basal surface of the second light emitting recess 322 along the second inclined surface 320*b*.

The plurality of main light emitting diodes 324 may be provided on the second substrate 323 along the second inclined surface 320*b*, and the main light emitting diodes 314 may be electrically connected to the second substrate 323. Otherwise, a plurality of electrodes may be provided on the second inclined surface 320*b*, and then the plurality of main light emitting diodes 324 may be electrically connected to the second substrate 323, respectively. The plurality of main light emitting diodes 324 may be arranged in the second light emitting recess 322 in the form of an array.

The plurality of main light emitting diodes 324 may be determined through various combinations of red, green, blue and white light emitting diodes that radiate red, green, blue and white light respectively.

The plurality of main light emitting diodes 324 may be controlled by electric power and/or a driving signal that are provided by the power supply unit 400, causing a plurality of main light emitting diodes 324 to selectively emit light or to adjust luminance of light.

The second optical structure 325 may be provided on (or at) the plurality of the main light emitting diodes 324. The second optical structure 325 adjust light distribution and color sense of light radiated from the plurality of main light emitting diodes 324, and the second optical structure 325 may create emotional lighting having various luminance and color senses.

The second optical structure 325 may be inserted in a sliding way into a side recesses (or grooves) formed in the inner surface of the second light emitting recess 322. The side recess or recesses may extend in the first direction. The second optical structure 325 may be coupled to the second light emitting recess 322 by being inserted into the side recess or recesses.

The second optical structure 325 may include at least one of a lens, a diffusion sheet or a phosphor luminescent film (PLF). FIG. 7 also shows fins 327 provided over the diffusion sheet 325. The fins 327 may direct the light from the main light emitting diodes 324.

The lens may include various lenses such as a concave lens, a convex lens and/or a condensing lens according to a design of the lighting device.

The diffusion sheet may evenly diffuse light radiated from the plurality of main light emitting diodes 324.

The phosphor luminescent film (PLF) may include a fluorescent substance. Since the fluorescent substance included in the phosphor luminescent film (PLF) is excited by light radiated from the plurality of main light emitting diodes 324, the lighting device may produce emotional lighting having various color senses by mixing first light radiated from the plurality of main light emitting diodes 324 and second light excited by the fluorescent substance. For example, when the plurality of main light emitting diodes 324 radiate blue light and the phosphor luminescent film (PLF) includes a yellow fluorescent substance excited by blue light, the lighting device may radiate white light by mixing the blue light and the yellow light.

The second optical structure 325 may be coupled to the second light emitting recess 322 through the side recesses. Accordingly, a lens, a diffusion sheet and/or a phosphor luminescent film (PLF) may be alternately used as the second optical structure 325.

The depth and the width of the second light emitting recess 322 may be variously adjusted according to the light distribution of the plurality of main light emitting diodes 324 provided inside the second light emitting recess 322. In other words, the reflector 200 may provide users with light radiated from the light source unit 300 by adjusting the depth and the width of the second light emitting recess 322, rather than by directly providing users with light radiated from the light source unit 300. As a result, users may be provided with subdued light by reducing glare.

A light distribution angle of light emitted from the second light emitting recess 322 may be from 90° to 110°. The depth and the width of the second light emitting recess 322 may cause light emitted from the second light emitting recess 322 to be incident evenly on the reflector 200, and more particularly to the entire area of the reflector 200.

Additionally, the depth and the width of the second light emitting groove 322 may be adjusted such that a part of light radiated from the plurality of main light emitting diodes 324 may be radiated to the outside through the down opening 101 of the housing 100 and the rest of the light may be reflected by the reflector 200 and may be radiated to the outside through the down opening 101.

Since the structure in which the second optical structure 325 is provided in the second body 320 is substantially the same as the first optical structure 315, a further detailed description may be omitted. The second optical structure 325 may also be provided under a cut-off line, which is an imaginary line that extends from a top of one of the side recesses to a bottom edge of the housing 100.

As shown in FIGS. 6*a* and 7, a second hinge 321 may be formed on the other side of the lower portion of the second body 320. The second hinge 321 may have a shape that protrudes outward. The end of the second hinge 321 may be partially formed along the other side of the lower portion of the second body 320 (i.e., in the first direction). For example, the second hinge 321 may be formed only in a central portion of the other side of the lower portion of the second body 320, or may be formed vice-versa. A plurality of second hinges 321 may also be provided. The end of the second hinge 321 may have a cylindrical shape.

A second insertion recess 331 may be formed on both sides of the lower portion of the middle body 330, respectively. The second insertion recess 331 may have a cylindrical shape that extends in the first direction. The end of the second hinge 321 (of the second body 320) may be inserted into the second insertion recess 331 in a sliding way, so that the second body 320 is coupled to the middle body 330 in such a manner so as to rotate. The second body 320 may rotate at a predetermined angle by using the longitudinal direction of the second hinge 321 as a rotation axis. The structure between the second hinge 321 and the second insertion recess 331 is not limited to this description. Any configuration may be accepted as long as the structure can allow the second hinge 321 and the second insertion recess 331 to be coupled to each other such that they may rotate.

In the coupling of the second body 320 and the middle body 330, at least one third opening 329 may be formed in a second coupling unit that connects the second body 320 with the middle body 330. The third opening 329 may correspond to either a space from among a plurality of the second hinges 321 or a space where the second hinge 321 is not formed along the other side of the lower portion of the second body 320.

As described above, since the first body 310 and the second body 320 are formed in a same structure, the configurations may be the same.

The first body 310 and the second body 320 may be manufactured by an extrusion molding process in such a manner as to have a constant cross section in the first direction.

The first body 310 and the second body 320 may be made of a metallic material such as Al, Sn, Ni, Ag, Cu, Ti, Mo, W, Au and/or Pt in order to efficiently release heat generated from the plurality of main light emitting diodes 314 and 324.

The outer surface of the second portion (or other side) of the second body 320 may have a predetermined curved surface or may be angular.

C) The Middle Body 330

A second insertion recess 331 (or second insertion groove) may be formed on both sides of the lower portion 330*a* of the middle body 330. The second insertion recess 331 may extend in the first direction. The first hinge 311 (of the first body 310) and the second hinge 321 (of the second body 320) may be inserted into the second insertion recess 331. For example, as described above, the first hinge 311 and the second hinge 321 may be inserted into the second insertion recess 331, respectively in a sliding way. The method of inserting the hinge into the second insertion recess 331 is not limited to this description.

The first body 310 and the second body 320 may be coupled to both sides of the middle body 330 in an attachable and removable manner. The first body 310 and the second body 320 may be coupled to rotate about the first hinge 311 and the second hinge 321, respectively.

An auxiliary light source module 333, 334 and 335 may be provided on a basal surface (or bottom surface) of the lower portion 330*a* of the middle body 330. More specifically, a third light emitting recess 332 (or third light emitting groove) may be formed on the basal surface of the lower portion of the middle body 330, and the auxiliary light source module 333, 334 and 335 may be provided within the third light emitting recess 332. The auxiliary light source module 333, 334 and 335 may include a third substrate 333, a plurality of auxiliary light emitting diodes 334 and a third optical structure 335.

The third substrate 333 may be provided on the inner upper surface of the third light emitting recess 332. The plurality of auxiliary light emitting diodes 334 may be provided on the third substrate 333 and may be electrically connected to the third substrate 333. Otherwise, a plurality of electrodes may be provided on the inner upper surface of the third light emitting recess 332, and then the plurality of auxiliary light emitting diodes 334 may be electrically connected to the plurality of electrodes, respectively.

Both ends of the third optical structure 335 may be provided in a sliding way in the side recesses formed on the inner surface of the third light emitting recess 332. The side recesses may extend in the first direction. The third optical structure 335 may be provided in the third light emitting recess 332 by being inserted into the side recesses in the first direction.

The plurality of auxiliary light emitting diodes 334 may be controlled by electric power and/or a driving signal that are provided by the power supply unit 400, causing the plurality of auxiliary light emitting diodes 334 to selectively emit light or to adjust luminance of light. For example, the auxiliary light emitting diode 334 may be used in producing more illuminations, a subdued lighting condition and/or a display apparatus, for example.

The third optical structure 335 may be provided on the plurality of auxiliary light emitting diodes 334. The third optical structure 335 may adjust the light distribution and color sense of light radiated from the plurality of auxiliary light emitting diodes 334, and may create emotional lighting having various luminance and color senses.

The third optical structure 335 may include at least one of a lens, a diffusion sheet or a phosphor luminescent film (PLF).

The lens may include various lenses such as a concave lens, a convex lens and a condensing lens based on a design of the lighting device.

The diffusion sheet may evenly diffuse light radiated from the plurality of auxiliary light emitting diodes 334.

The phosphor luminescent film (PLF) may include a fluorescent substance. Since the fluorescent substance included in the phosphor luminescent film (PLF) is excited by light radiated from the plurality of auxiliary light emitting diodes 334, the lighting device may produce emotional lighting having various color senses by mixing a first light radiated from the plurality of auxiliary light emitting diodes 334 and a second light excited by the fluorescent substance. For example, when the plurality of auxiliary light emitting diodes 334 radiate blue light and the phosphor luminescent film (PLF) includes a yellow fluorescent substance excited by blue light, the lighting device radiates white light by mixing the blue light and yellow light.

The third optical structure 335 may be coupled through the side recesses of the third light emitting recess 332. Accordingly, a lens, a diffusion sheet and/or a phosphor luminescent film (PLF) may be alternately used as the second optical structure 325.

The middle body 330 may be manufactured by an extrusion molding process so as to have a constant cross section in the first direction and to have a symmetrical structure.

As described above, when the first body 310, the second body 320 and the middle body 330 are coupled to each other, the outer surfaces of the first hinge 311 and the second hinge 321 are in contact with the inner surface of the second insertion recess 331, so that a heat release path exists between the first body 310, the second body 320 and the middle body 330. Therefore, in order to improve the heat radiating effect, the lower portion 330*a* of the middle body 330 may be made of a metallic material having a high thermal conductivity, for example, Al, Sn, Ni, Ag, Cu, Ti, Mo, W, Au and/or Pt. Since electrical components are provided in the upper portion 330*b* of the middle body 330, heat may not be transferred to the upper portion 330*b* of the middle body 330. Therefore, the upper portion 330*b* of the middle body 330 may be made of a material having a low thermal conductivity (e.g., plastic material and the like) such that heat generated by the lower portions of the first body 310, the second body 320 and the middle body 330 may be prevented (or reduced) from being transferred.

The heat generated from the main light emitting diodes 314 and 324 and the auxiliary light emitting diode 334 may be released by the body of the light source unit 300 or may be transferred to the coupling member 110, and then may be released. That is, when the light source unit 300 is inserted into the first insertion recess 112 of the coupling member 110, the third coupling unit 310*a* and the fourth coupling unit 320*a* may contact the inner surface of the first insertion recess 112. As such, one side of the third coupling unit 310*a* and the fourth coupling unit 320*a* may contact the inner surface of the first insertion recess 112, and a thermal conductivity route from the light source unit 300 to the coupling member 110 may be formed. Accordingly, a greater heat radiating effect may occur when a larger contact area is provided. However, heights of the first body 310 and the second body 320 may be increased, so that the height of the housing 100 may need to be increased. Therefore, in order for the lighting device to have optimal heat radiating effect, a relationship between the contact area and the height of the housing 100 should be considered. A part of the body of the light source unit 300 may have an uneven structure, thereby effectively releasing the heat.

The coupling unit 110 of the housing 100 may include the first insertion recess 112 of which the inner wall surface extends by the length of the light source unit 300 (i.e., extends in the first direction). The light source may include both a light source seat that directly contacts a light source, and the third coupling unit 310*a* and the fourth coupling unit 320*a* that contact the inner wall surface of the first insertion recess 112 of the coupling unit 110. The light source seat may include the light emitting recess and the lower portion of the light source unit 300. The light emitting recess may include the light emitting diodes therein. The light emitting recess may be formed in the lower portion of the light source unit 300. When the lighting device is operated, heat generated from the light source seat may be transferred to the coupling unit 110 through the third coupling unit 310*a* and the fourth coupling unit 320*a*. In this example, the third coupling unit 310*a* and the fourth coupling unit 320*a* may contact the inner wall surface of the first insertion recess 112, so that heat generated from the light source seat can transfer to the coupling unit 110. Since the inner wall surface of the first insertion recess 112 extends by the length of the light source unit 300 (i.e., extends in the first direction), a maximum contact area of the third coupling unit 310*a* and the fourth coupling unit 320*a* may be obtained. As a result, the heat radiating effect of the lighting device may be improved.

Figure 8:
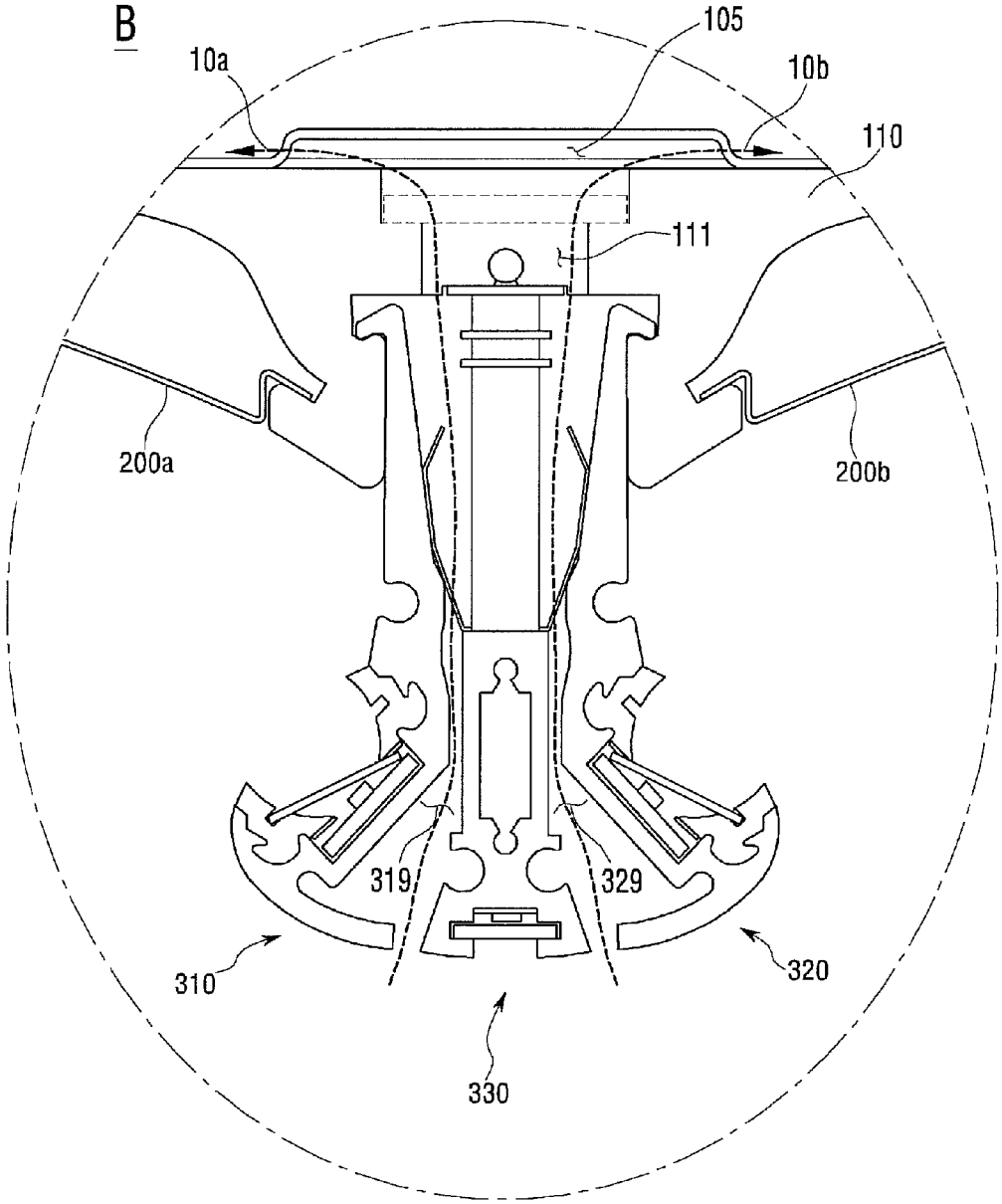
FIG. 8 is a view for describing an indoor air circulation path of a lighting device.

FIG. 8 is a view for describing an indoor air circulation path of the lighting device 1.

As shown in FIG. 8, the lighting device 1 may include a first air circulation path 10*a* and a second air circulation path 10*b*.

The first air circulation path 10*a* may include the first opening 105 formed in the housing 100, the second opening 111 formed in the coupling member 110, and the third opening 319 formed in the first body 310 and the first coupling unit of the middle body 330.

The second air circulation path 10*a* may include the first opening 105 formed in the housing 100, the second opening 111 formed in the coupling member 110, and the third opening 329 formed in the second body 320 and the second coupling unit of the middle body 330.

Therefore, the lighting device 1 may obtain the indoor air circulation path that includes the first opening 105, the second opening 111 and the third openings 319 and 329, thereby lowering a temperature of the light source unit 300 and obtaining an excellent heat radiating characteristic.

Since the lower portions of the first body 310 and the second body 320 are manufactured to have inclined surfaces facing the reflector 200, regarding the cross section of the light source unit 300 formed by coupling the first body 310, the second body 320 and the middle body 330, a width of the lower portion of the light source unit 300 may be greater than a width of the upper portion of the light source unit 300. For example, the cross section of the light source unit 300 may have a fan shape or a polygon shape. However, the shape of the cross section of the light source unit 300 may not be limited to this. The light source unit 300 may have various shapes.

D) The Spring 340

The spring 340 may be provided on the middle body 330. For example, as shown in FIG. 8, the spring 340 may have a U-shape, and may be provided between the lower portion 330*a* and the upper portion 330*b* of the middle body 330. When the first body 310 and the second body 320 are coupled to both sides of the middle body 330, the spring 340 may contact the inner surfaces of the first body 310 and the second body 320.

The spring 340 may provide the first body 310 and the second body 320 with an elastic force to widen a space between the first body 310 and the second body 320. That is, the spring 340 may be provided between the first body 310 and the second body 320 and may push the first body 310 and the second body 320 outward. Accordingly, when the light source unit 300 is inserted into the coupling member 110, the first projection 310*c* and the second projection 320*c* may be caught by the locking recess 113, so that the light source unit 300 may be more strongly coupled to the coupling member 110 by the force from the spring 340.

The spring 340 may apply the force to push the upper portions of the first body 310 and the second body 320 outwards. Based on the outward pushing force, a force toward the middle body 330 may be applied to the lower portions of the first body 310 and the second body 320. As a result, the first body 310 and the second body 320 may be in balance and may be supported to the middle body 330.

E) The First Connection Terminal 120 and the Second Connection Terminal 336

Figure 9:
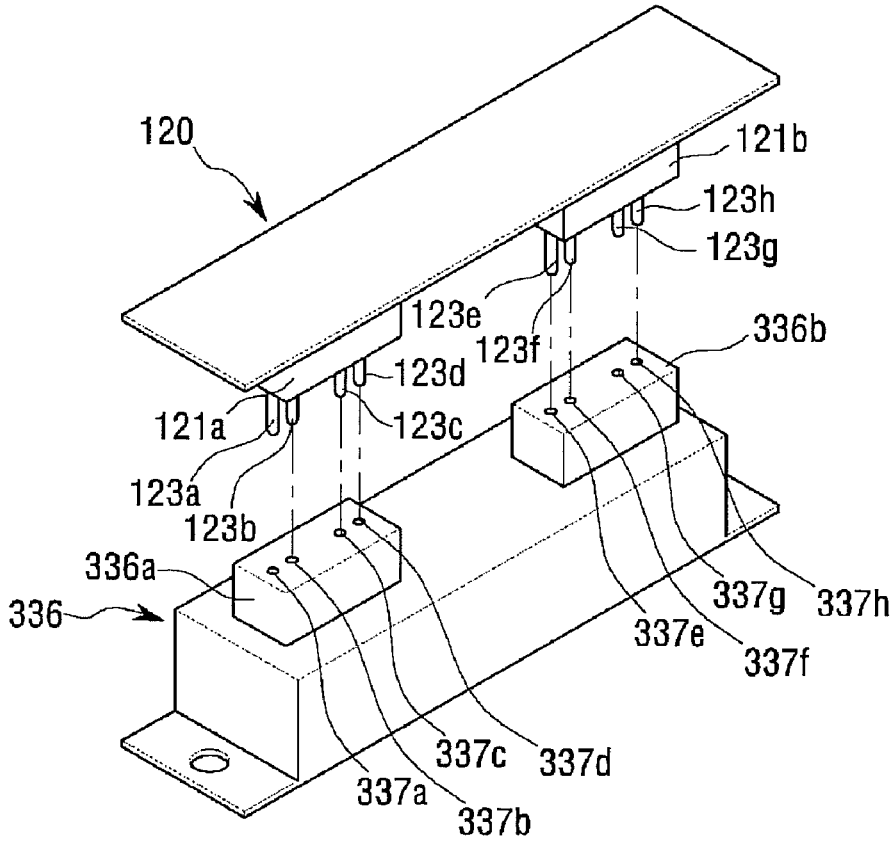
FIGS. 9 to 11 show configurations of a first connection terminal and a second connection terminal.
Figure 10:
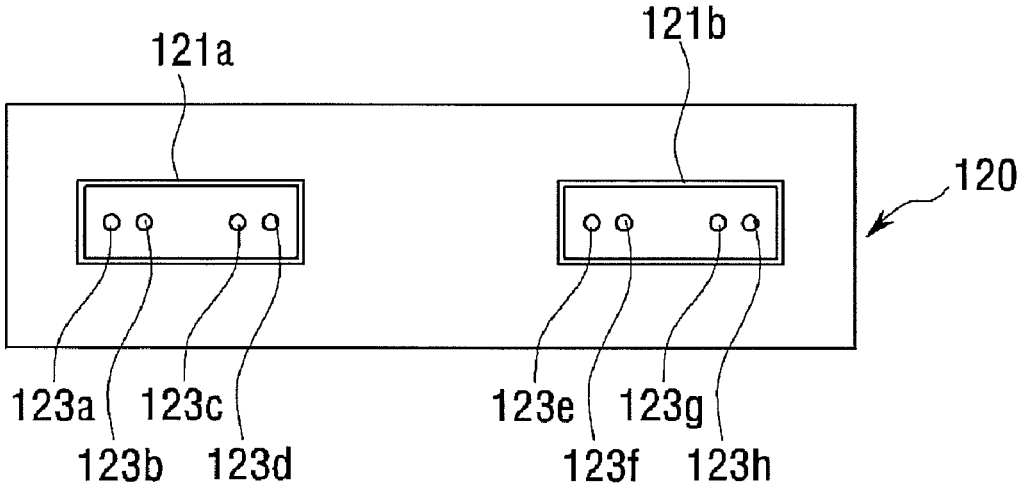
Figure 11:
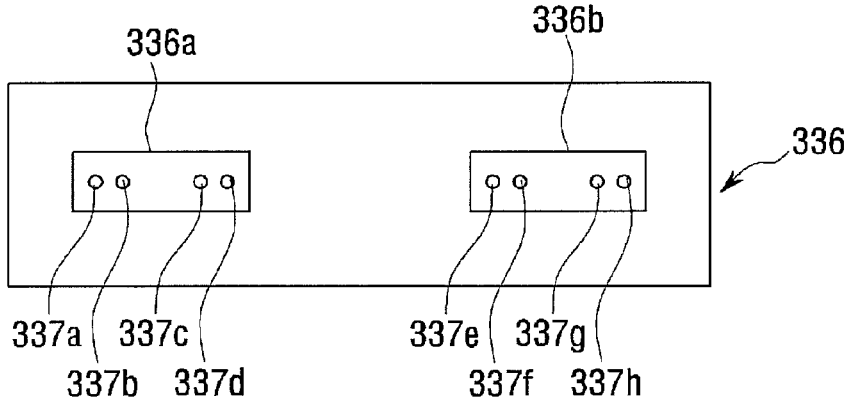

FIGS. 9 to 11 show a first connection terminal 120 and a second connection terminal 336.

The first and the second connection terminals 120 and 336 may be coupled to each other by inserting the light source unit 300 into the first insertion recess 112.

The first connection terminal 120 may include a first female block 121*a* and a second female block 121*b* and without being limited to this embodiment, the first connection terminal 120 may include at least one pair of the female blocks. For example, the first female block 121*a* may include a first pair of a first terminal 123*a* and a second terminal 123*b* and second pair of a third terminal 123*c* and a fourth terminal 123*d*. The second female block 121*b* may include a third pair of a fifth terminal 123*e* and a sixth terminal 123*f* and a fourth pair of a seventh terminal 123*g* and an eighth terminal 123*h*.

The first female block 121*a* and the second female block 121*b* may be symmetrical to each other. That is, the first to the fourth terminals 123*a* to 123*d* and the fifth to the eighth terminals 123*e* to 123*h* may be symmetrical with respect to a line between the first female block 121*a* and the second female block 121*b*. The second connection terminal 336 may include a first male block 336*a* and a second male block 336*b* and without being limited to this embodiment, the first connection terminal 120 may include at least one pair of the male blocks. For example, the first male block 336*a* may include a fifth pair of a first socket 337*a* and a second socket 337*b* and a sixth pair of a third socket 337*c* and a fourth socket 337*d*. The second male block 336*b* may include a seventh pair of a fifth socket 337*e* and a sixth socket 337*f* and an eight pair of a seventh socket 337*g* and an eighth socket 337*h*.

The first male block 336*a* and the second male block 336*b* may be symmetrical to each other. That is, the first to the fourth sockets 3373*a* to 337*d* and the fifth to the eighth sockets 337*e* to 337*h* may be symmetrical with respect to a line between the first male block 336*a* and the second male block 336*b*.

The polarity of the first female block 121*a* and the polarity of the second female block 121*b* may be symmetrical to each other.

The polarities of the first and the second terminals 123*a* and 123*b* may be symmetrical to the polarities of the seventh and the eighth terminals 123*g* and 123*h*. For example, if the polarities of the first and the second terminals 123*a* and 123*b* are '+' and '−', respectively, the polarities of the seventh and the eighth terminals 123*g* and 123*h* are '−' and '+', respectively. If the polarities of the first and the second terminals 123*a* and 123*b* are and '−' and '+', respectively, the polarities of the seventh and the eighth terminals 123*g* and 123*h* are '+' and '−' respectively.

Additionally, the polarities of the third and the fourth terminals 123*c* and 123*d* may be symmetrical to the polarities of the fifth and the sixth terminals 123*e* and 123*f*. For example, if the polarities of the third and the fourth terminals 123*c* and 123*d* are '+' and '−', respectively, the polarities of the fifth and the sixth terminals 123*e* and 123*f* are '−' and '+', respectively. If the polarities of the third and the fourth terminals 123*c* and 123*d* are '−' and '+', respectively, the polarities of the fifth and the sixth terminals 123*e* and 123*f* are '+' and '−', respectively.

The polarities of the first to the eighth sockets 337*a* to 337*h* may be various formed based on polarities of the first to the eighth terminals 123*a* to 123*h*.

When the light source unit 300 is coupled to the coupling member 110 in the first direction, the first connection terminal 120 may be electrically and physically connected to the second connection terminal 336 by inserting the first and the second terminals 123*a* and 123*b* into the first and the second sockets 337*a* and 337*b*, inserting the third and the fourth terminals 123*c* and 123*d* into the third and the fourth sockets 337*c* and 337*d*, inserting the fifth and the sixth terminals 123*e* and 123*f* into the fifth and the sixth sockets 337*e* and 337*f*, and inserting the seventh and the eighth terminals 123*g* and 123*h* into the seventh and the eighth sockets 337*g* and 337*h*.

Additionally, when the light source unit 300 is coupled to the coupling member 110 in a second direction (i.e., a reverse direction to the first direction or in a rightside-left direction), the first connection terminal 120 may be electrically and physically connected to the second connection terminal 336 by inserting the first and the second terminals 123*a* and 123*b* into the seventh and the eighth sockets 337*g* and 337*h*, inserting the third and the fourth terminals 123*c* and 123*d* into the fifth and the sixth sockets 337*e* and 337*f*, inserting the fifth and the sixth terminals 123*e* and 123*f* into the third and the fourth sockets 337*c* and 337*d*, and inserting the seventh and the eighth terminals 123*g* and 123*h* into the first and the second sockets 337*a* and 337*b*. As such, since structures and polarities of the first connection terminal 120 and the second connection terminal 336 may be symmetrical to each other, the light source unit 300 may be coupled to the coupling member 110 irrespective of the coupling direction. Accordingly, the lighting device 1 may make it easier to couple the light source unit 300 to the coupling member 110, and thereby enhance a convenience for use.

When the light source unit 300 is coupled to the coupling member 110, the first, second, seventh and eighth terminals 123*a*, 123*b*, 123*g* and 123*h* may be used as connectors for transferring electric power. The third, fourth, fifth and sixth terminals 123*c*, 123*d*, 123*e* and 123*f* may be used or not as connectors for transferring a driving signal.

The third, fourth, fifth and sixth terminals 123*c*, 123*d*, 123*e* and 123*f* may be used as connectors for transferring electric power. The first, second, seventh and eighth terminals 123*a*, 123*b*, 123*g* and 123*h* may be used or not as connectors for transferring a driving signal.

Although it is described that the first connection terminal 120 includes the first female block, and the second connection terminal 336 includes the first male block, it does not matter that the first connection terminal 120 includes the first male block, and the second connection terminal 336 includes the first female block.

5. The End Cap 350

Figure 12:
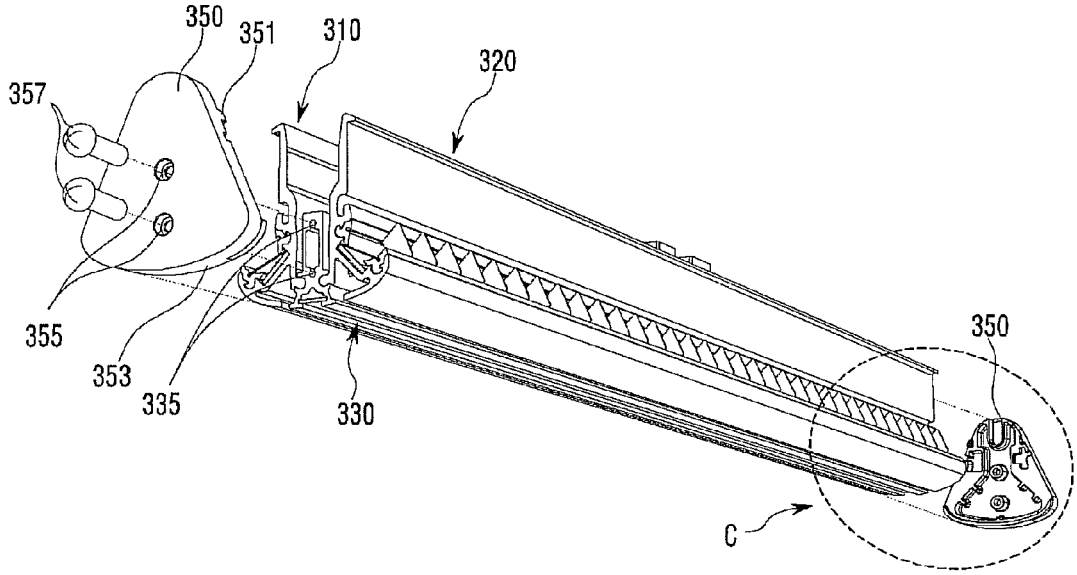
FIG. 12 shows a light source unit coupled to an end cap.
Figure 13:
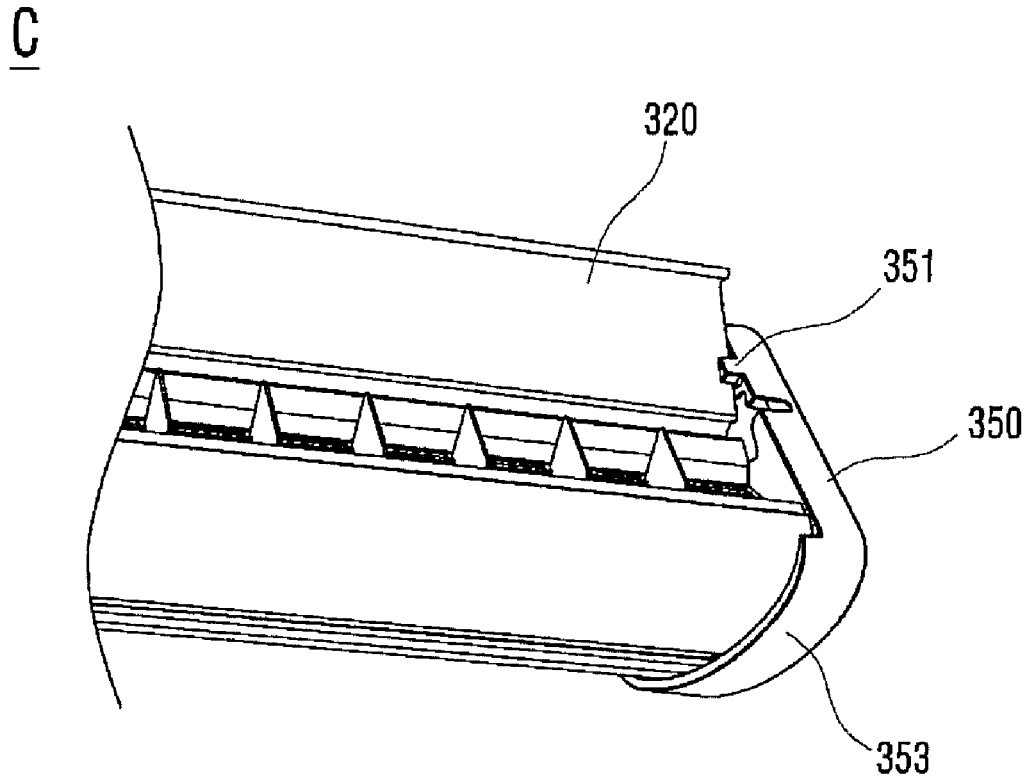
FIG. 13 shows a light source unit coupled to an end cap.

FIG. 12 shows an end cap 350 to be coupled to the light source unit 300 in accordance with an example embodiment. FIG. 13 shows the end cap 350 coupled to the light source unit 300 350 in accordance with the embodiment. Other embodiments and configurations may also be provided.

As shown in FIG. 12, the end cap 350 may be coupled to both ends of the light source unit 300. For example, the end cap 350 may be coupled to both ends of the middle body 330 by a bolt-fastening method, so that both sides of each of the first body 310, the second body 320 and the middle body 330 may be covered with the end cap 350. At least one bolt-hole 355 may be formed in a central portion of the end cap 350. A fastener 335 may be formed at both sides of the middle body 330, and the position of the fastener 335 may correspond to the bolt-hole 355. Accordingly, the end cap 350 may be fastened to the fastener 335 of the middle body 330 by a bolt 357 and a bolt-hole 355, so that the end cap 350 may be coupled to the light source unit 300.

As shown in FIG. 13, a deterrent protrusion 351 may be provided in both upper side ends of the end cap 350 in order to prevent the first body 310 and the second body 320 from separating. The spring 340 may apply a force to push the first body 310 and the second body 320 outward. When the force causes a space between the first body 310 and the second body 320 to be widened to a certain extent, the space between the first body 310 and the second body 320 may not be widened any more because the first body 310 and the second body 320 are attached by the deterrent protrusion 351. A maximum angle between the first body 310 and the second body 320 may be formed by the deterrent protrusion 351.

A preventer 353 may be formed in a lower portion of the end cap 350. The preventer 353 may have a shape that projects from the lower end of the end cap 350 to support the lower portion of the light source unit 300 when the end cap 350 is coupled to the light source unit 300. Therefore, when the end cap 350 is coupled to the light source unit 300, the preventer 353 may support the lower portions of the first body 310, the second body 320 and the middle body 330.

Since the light source unit 300 has a structure in which the first body 310 and the second body 320 are movable, a gap may be formed between the lower portions of the first body 310, the middle body 330 and the second body 320. Therefore, light may leak through the gap. The preventer 353 may surround the lower portion of the light source unit 300 and prevent the light from leaking between the lower portions of the first body 310, the second body 320 and the middle body 330.

The end cap 350 may be coupled to the light source unit 300 by the bolt-fastening method, so that the light source unit 300 may be more stably fixed and supported. The preventer 353 of the light source unit 300 may further prevent the light from leaking. Since the bolt fastener of the end cap 350 causes the first body 310, the second body 320 and the middle body 330 to more closely contact each other, heat transfer efficiency of the light source unit 300 may be improved.

6. Coupling and Separation of the Light Source Unit 300 and the Coupling Member 110

Figure 14:
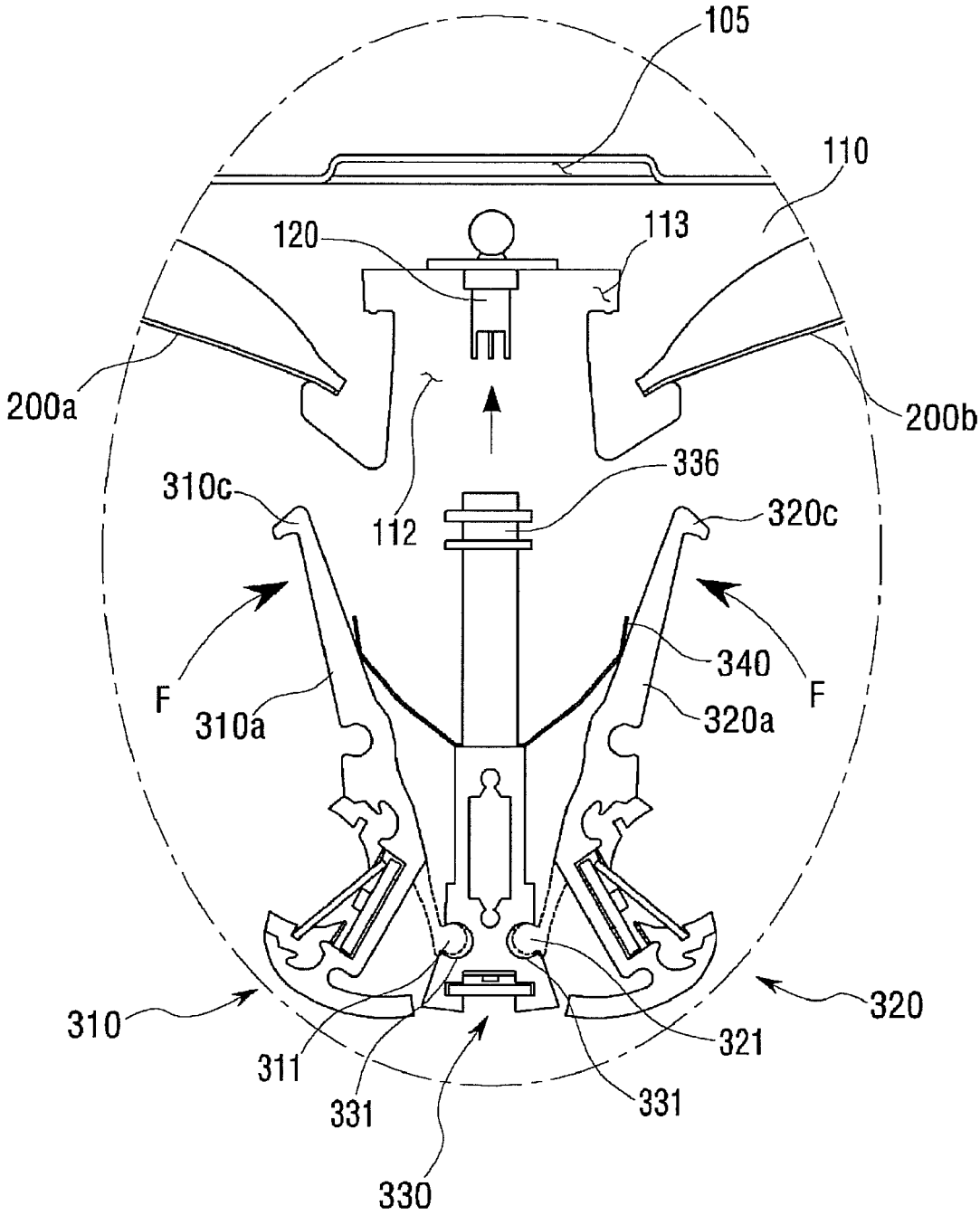
FIGS. 14 and 15 are views describing how a light source unit is coupled to and separated from a coupling member.
Figure 15:
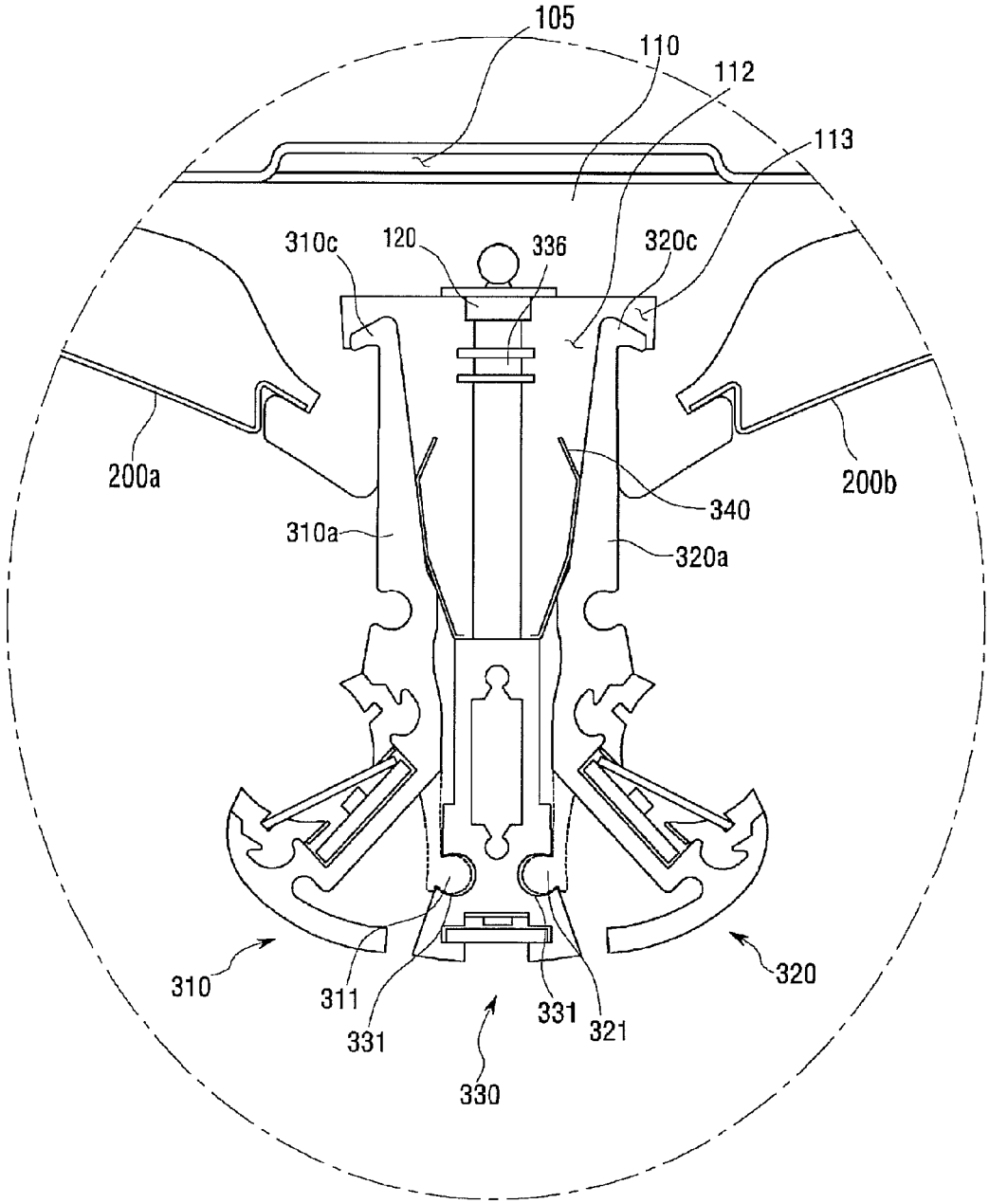

FIGS. 14 and 15 are views for describing how the light source unit 300 is coupled to and separated from the coupling member 110 in accordance with an embodiment. Other embodiments and configurations may also be provided.

A) The Coupling Process

As shown in FIG. 14, an angle between the first body 310 and the second body 320 may be reduced by applying a first force F to the first body 310 and the second body 320 of the light source unit 300. A direction of the first force F may be reverse to the direction of the elastic force applied by the spring 340. When the lower portions of the third and the fourth coupling units 310*a* and 320*a* are pressed by applying the first force F, a space between the third and the fourth coupling units 310*a* and 320*a* may be reduced, so that an angle between the first body 310 and the second body 320 is reduced. When the first force F is not applied, a space between the first body 310 and the second body 320 may be widened by the elastic force applied by the spring 340, so that it may be difficult to insert the light source unit 300 into the first insertion groove 112 of the coupling member 110.

As the first force F is applied to the first and the second bodies 310 and 320, the light source unit 300 may be inserted into the first insertion recess 112 of the coupling member 110.

As shown in FIG. 15, when the first force F is not applied, a space between the first and the second bodies 310 and 320 may be widened again, the first projection 310*c* of the upper portion of the first body 310 and the second projection 320*c* of the upper portion of the second body 320 may be respectively inserted into and caught by the locking recess 113 formed in both inner sides of the first insertion recess 112. As a result, the light source unit 300 may be coupled to the coupling member 110.

When the light source unit 300 is inserted into the coupling member 110, the spring 340 between the first body 310 and the second body 320 may push the first body 310 and the second body 320. Therefore, the first projection 310*c* and the second projection 320*c* may be more securely attached to the locking recess 113.

The spring 340 may continuously provide a uniform pressure to a contact surface formed by causing the third coupling unit 310*a* and the fourth coupling unit 320*a* to contact the first insertion groove 112. Therefore, heat generated from the light source unit 300 may be more efficiently transferred through the contact surface.

B) The Separation Process

When the light source unit 300 needs to be repaired, the light source unit 300 may be separated from the coupling member 110.

In separating the light source unit 300 from the coupling member 110, after an angle between the first body 310 and the second body 320 is reduced by applying the first force F to the first body 310 and the second body 320, the light source unit 300 may be separated from the coupling member 110.

Another Embodiment

Figure 16:
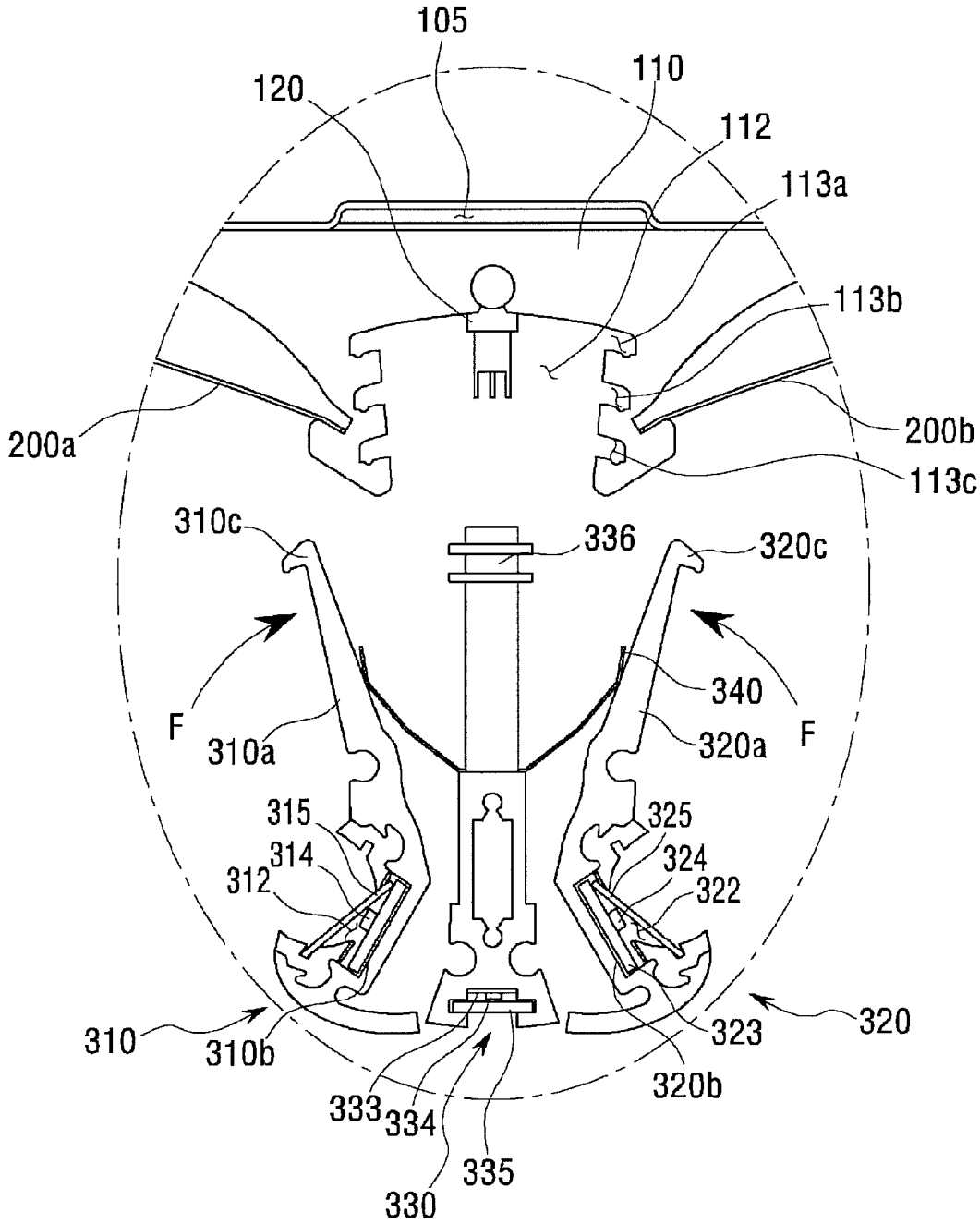
FIGS. 16 and 17 are cross sectional views of a light source unit and a coupling member of a lighting device according to an embodiment.
Figure 17:
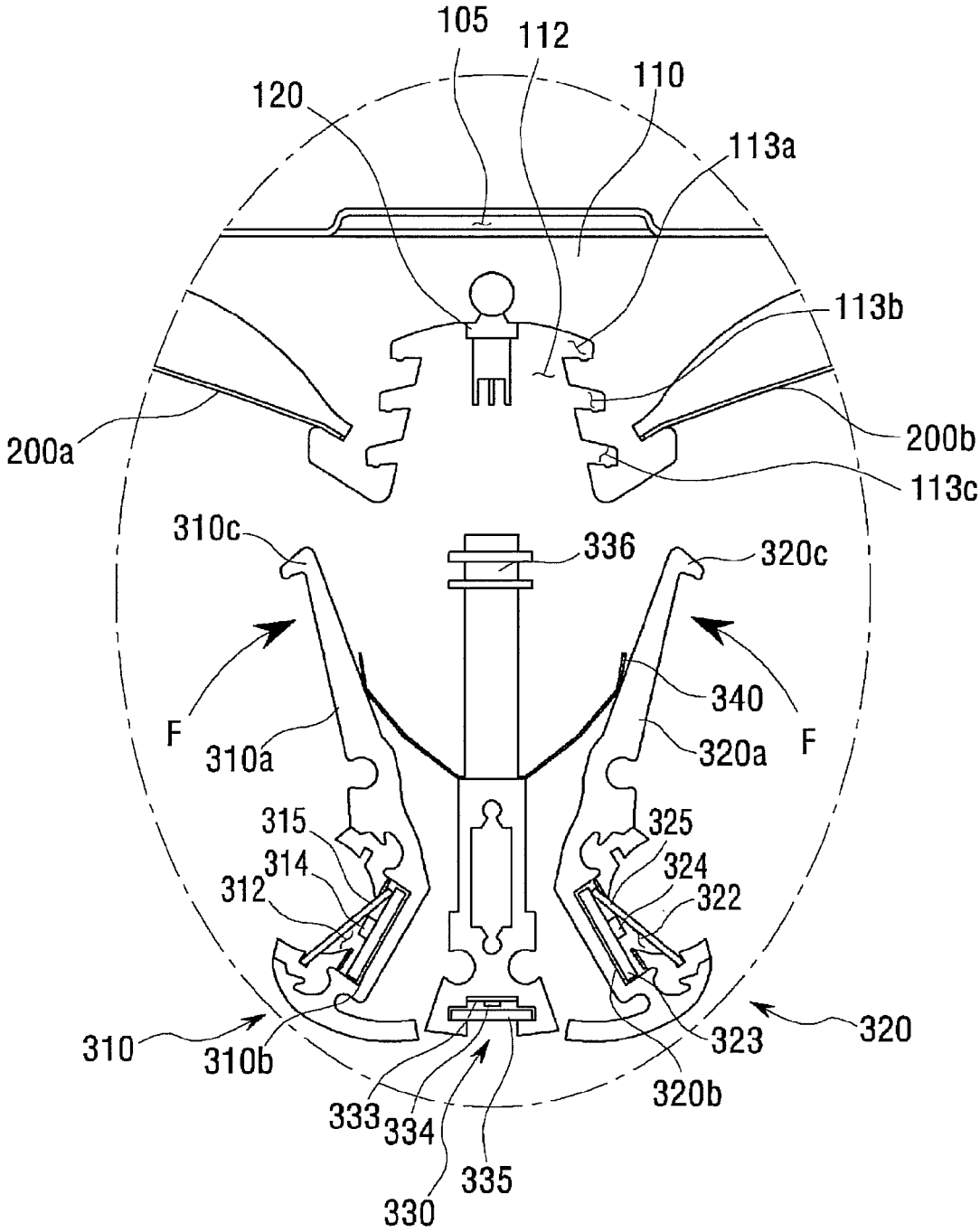

FIGS. 16 and 17 are cross sectional views of a light source unit and a coupling member of a lighting device according to an embodiment. Other embodiments and configurations may also be provided. In the description of the lighting device according to this embodiment, repetitive descriptions may be omitted.

The plurality of locking recesses 113*a*, 113*b* and 113*c* may be formed on the inner surface of the first insertion recess 112 of the coupling member 110. While the three locking recesses 113*a*, 113*b* and 113*c* are shown, there is no limit to the number of the locking recesses.

The upper portion of the light source unit 300 may be inserted into and coupled to the first insertion recess 112. The first projection 310*c* and the second projection 320*c* formed in the upper portion of the light source unit 300 may be inserted into one pair of the locking recesses from among the plurality of locking recesses 113*a*, 113*b* and 113*c*, so that the light source unit 300 may be strongly coupled to the coupling member 110.

As shown in FIG. 16, depths of the plurality of locking recesses 113*a*, 113*b* and 113*c* may be different from each other, the light distribution of the lighting device may diversely adjust in accordance with what recess the first projection 310*c* and the second projection 320*c* are inserted into from among the plurality of locking recesses 113*a*, 113*b* and 113*c*.

As shown in FIG. 17, the first insertion recess 112 may have an inclined inner surface. When the plurality of the locking recesses 113*a*, 113*b* and 113*c* are formed on the inclined inner surface of the first insertion recess 112, an angle between the first body 310 and the second body 320 of the light source unit 300 may vary in accordance with what recess the first projection 310*c* and the second projection 320*c* are inserted into from among the plurality of locking recesses 113*a*, 113*b* and 113*c*. Therefore, light distribution of the lighting device may be diversely adjusted.

As described above, the light distribution of the lighting device may be diversely adjusted by forming a plurality of locking recesses 113*a*, 113*b* and 113*c* on the inner surface of the first insertion recess 112. As a result, even though a width or a curvature of the reflector 200 changes, an efficient lighting may be provided without changing the light source unit 300.

A lighting device may include: a housing; a coupling member coupled to the housing; a reflector coupled between the housing and the coupling member; and a light source unit being coupled to the coupling member and emitting light toward the reflector, wherein the light source unit includes a first body and a second body, wherein at least one of one sides of the first body and the second body is coupled to the coupling member, and wherein at least one of the other sides of the first body and the second body includes a light source module which includes a light emitting device emitting light toward the reflector.

A lighting device may also include: a housing; a coupling member coupled to the housing; a reflector coupled between the housing and the coupling member; a light source unit being coupled to the coupling member and including a light emitting device emitting light toward the reflector; and an end cap coupled to ends of the light source unit.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a housing;

a coupling member coupled to the housing;

a reflector coupled between the housing and the coupling member; and a light source unit coupled to the coupling member to emit light toward the reflector, wherein the light source unit includes a first body and a second body, wherein at least one first portion of the first body is coupled to the coupling member, and wherein at least one second portion of the first body includes a light source module having a light emitting diode to emit light toward the reflector, wherein the housing includes at least one first opening, wherein the coupling member includes at least one second opening corresponding to the first opening of the housing, and wherein a third opening for air circulation is provided between the first body and the second body.

2. The lighting device of claim 1, wherein the second portion of the first body is substantially at an end of the first body.

3. The lighting device of claim 1, wherein the light source unit further includes a middle body provided between the first body and the second body.

4. The lighting device of claim 3, wherein the third opening for air circulation is provided between the first body and the middle body.

5. The lighting device of claim 4, wherein the middle body includes a first portion and a second portion, the first portion of the middle body includes a second connection terminal to electrically connect to the coupling member, wherein a light emitting recess is provided on the second portion of the middle body, wherein the light source module is provided at a surface of the light emitting recess, and wherein the light source module of the middle body includes:

a substrate in the light emitting recess;

a light emitting device on the substrate; and an optical structure on the light emitting device.

6. The lighting device of claim 3, wherein one of the first body or the second body has a hinge provided in a shape that protrudes outward, and wherein the middle body has an insertion recess coupled to the hinge.

7. The lighting device of claim 3, wherein an outer surface of the second portion of the first body has a predetermined curved surface or is angular.

8. A lighting device comprising:

a housing;

a coupling member coupled to the housing;

a reflector coupled between the housing and the coupling member; and a light source unit coupled to the coupling member to emit light toward the reflector, wherein the light source unit includes a first body and a second body, wherein at least one first portion of the first body is coupled to the coupling member, wherein at least one second portion of the first body includes a light source module having a light emitting diode to emit light toward the reflector, wherein the coupling member includes a first insertion recess, wherein the at least one first portion of the first body includes a coupling unit to couple to the first insertion recess of the coupling member, and wherein the at least one second portion of the first body includes a light emitting recess to receive the light source module.

9. The lighting device of claim 8, wherein the first insertion recess includes a locking opening, wherein the coupling unit includes a first projection provided in the first body and a second projection provided in the second body, and wherein the first projection and the second projection are inserted into and caught by the locking opening, to couple the light source unit to the coupling member.

10. The lighting device of claim 9, wherein when the coupling unit is coupled to the coupling member, the coupling unit contacts an inner surface of the first insertion recess such that heat generated from the light source unit is transferred to the coupling member.

11. The lighting device of claim 8, wherein the light source module is provided at a surface of the light emitting recess, wherein the light source module includes:

a substrate in the light emitting recess;

a light emitting device on the substrate; and an optical structure on the light emitting device, wherein the surface of the light emitting recess is inclined with respect to a top surface of the housing.

12. The lighting device of claim 11, wherein a distance between two sides of the light emitting recess is different than a width of the surface of the light emitting recess.

13. The lighting device of claim 12, wherein the optical structure is provided under a cut-off line, wherein the cut-off line is an imaginary line that extends from a top side of the light emitting recess to a bottom edge of the housing.

14. The lighting device of claim 11, wherein the optical structure is flat and is inclined with respect to a top surface of the housing.

15. The lighting device of claim 11, wherein the optical structure includes at least one of a lens, a diffusion sheet or a phosphor luminescent film (PLF).

16. The lighting device of claim 8, wherein the light source unit includes a spring to provide an elastic force between the first body and the second body, and the spring is provided between the first body and the second body.

17. The lighting device of claim 8, wherein the housing includes a first recess, wherein the coupling member includes a second recess, wherein a first side of the reflector is coupled to the first recess of the housing, and a second side of the reflector is coupled to the second recess of the housing.

18. The lighting device of claim 1, further comprising an end cap to couple to an end of the light source unit.

19. A lighting device comprising:

a housing;

a coupling member coupled to the housing;

a reflector coupled between the housing and the coupling member;

a light source unit to couple to the coupling member, the light source unit including a light emitting diode(LED) to emit light toward the reflector;

a first end cap coupled to a first end of the light source unit; and a second end cap coupled to a second end of the light source unit.

20. The lighting device of claim 19, wherein the light source unit comprises a first body, a second body and a middle body between the first body and the second body, wherein a lower portion of the end cap includes a preventer to prevent light from leaking through the ends of the light source unit, and wherein an upper portion of the end cap includes a deterrent protrusion to support the first body and the second body.

* * * * *

UNITED STATES PATENT AND TRADEMARK OFFICE

CERTIFICATE OF CORRECTION

PATENT NO. : 8,220,955 B2
APPLICATION NO. : 13/190180
DATED : July 17, 2012
INVENTOR(S) : Young Kuk Kwak and Sang Jun Hong It is certified that error appears in the above-identified patent and that said Letters Patent is hereby corrected as shown below:

On the title page insert item
--(30) Foreign Application Priority Data

| | | |
|---|---|---|
| Sept. 16, 2010 | (KR) | 10-2010-0090905 |
| Sept. 16, 2010 | (KR) | 10-2010-0090906 |
| Sept. 16, 2010 | (KR) | 10-2010-0090910-- |

Signed and Sealed this
Second Day of October, 2012

David J. Kappos

David J. Kappos
*Director of the United States Patent and Trademark Office*